United States Patent [19]

Andoh et al.

[11] 4,147,960

[45] Apr. 3, 1979

[54] PLASMA DISPLAY PANEL INCLUDING SHIFT CHANNELS AND METHOD OF OPERATING SAME

[75] Inventors: Shizuo Andoh; Kazuo Yoshikawa, both of Kobe, Japan

[73] Assignee: Fujitsu Limited, Japan

[21] Appl. No.: 855,439

[22] Filed: Nov. 28, 1977

[30] Foreign Application Priority Data

| | | | |
|---|---|---|---|
| Dec. 6, 1976 | [JP] | Japan | 51-146983 |
| May 31, 1977 | [JP] | Japan | 52-63649 |
| May 31, 1977 | [JP] | Japan | 52-63650 |
| May 31, 1977 | [JP] | Japan | 52-63651 |

[51] Int. Cl.[2] ..... H01J 61/067; H01J 61/10; H05B 37/00; H05B 41/14

[52] U.S. Cl. ..... 340/769; 313/217; 315/169.2; 315/169.4; 340/773; 340/774; 340/779; 340/792; 340/798

[58] Field of Search ..... 313/217; 315/169 TV

[56] References Cited

U.S. PATENT DOCUMENTS

| | | | |
|---|---|---|---|
| 3,792,301 | 2/1974 | Kessler | 313/217 X |
| 3,801,851 | 4/1974 | Andoh et al. | 313/220 |
| 3,886,389 | 5/1975 | Ogle | 313/217 X |
| 3,975,725 | 8/1976 | Ogle | 313/217 X |
| 3,991,341 | 11/1976 | Ngo | 313/217 X |
| 3,995,185 | 11/1976 | Miller | 313/217 |

*Primary Examiner*—Palmer C. Demeo
*Attorney, Agent, or Firm*—Staas & Halsey

[57] ABSTRACT

A gas discharge panel in which a pair of substrates each has provided thereon a plurality of buses and a plurality of electrodes regularly connected to the buses, and in which the substrates are disposed opposite to each other with a discharge gas sealing space defined therebetween. By applying switching voltages to the buses, discharge spots between pair of opposed electrodes are sequentially shifted. No cross-over parts for electrode connections are present on the substrates.

31 Claims, 28 Drawing Figures

PLASMA DISPLAY PANEL INCLUDING SHIFT CHANNELS AND METHOD OF OPERATING SAME

BACKGROUND OF THE INVENTION

1. Field of the Invention

This invention relates to improvements in a gas discharge panel having a discharge spot scan or shift mechanism, and more particularly to a gas discharge panel having a novel electrode structure for scanning or shifting of discharge spots.

2. Description of the Prior Art

Heretofore, there has been known in the art, a DC discharge type gas discharge panel having a discharge spot scanning mechanism, for example, the gas discharge display panel developed by Burroughs Corporation of U.S.A. and placed on the market under the name of "SELF SCAN" (Registered Trademark). In the discharge spot scanning mechanism of the abovesaid conventional gas discharge display panel, as described in the detail, for instance, in U.S. publication "ELECTRONICS," Mar. 2, 1970 (Vol. 34, No. 5), pp. 120–135, cathodes for scanning are disposed to perpendicularly intersect defining anodes for scan lines in transverse relation to the anodes. In this prior art device the cathodes are periodically connected to three buses in sequential switchingly order and voltages are switchingly applied to the buses one after another, so that a discharge spot produced at one end of each scan line is shifted to adjacent cathodes one after another. With such a conventional scanning mechanism, however, it is desirable to periodically connect the scanning cathodes to the three buses in a sequential order on a cathode support substrate so as to minimize the number of terminals for external connections, and the use of the so-called crossover techniques for insulating each electrode connected to one of the buses from the other buses is unavoidable. This introduces appreciable complexity in the manufacture of the panel.

Also, in other prior art DC or AC discharge types of self-shift gas discharge display panels, it is necessary to periodically connect shift electrodes to three or more buses on a substrate supporting the electrodes. Accordingly, these display panels also encounter the problem of the troublesome crossover techniques for insulating of intersecting parts of electrodes and buses.

SUMMARY OF THE INVENTION

One object of this invention is to provide a gas discharge panel which has a discharge spot scan or shift mechanism and which does not require any cross-over parts of electrodes for their connection with buses, and hence which is easy to manufacture.

Another object of this invention is to provide a gas discharge panel which is adapted to provide a display corresponding to input information by the scanning of a discharge spot serving as a priming fire.

Still another object of this invention is to provide a gas discharge panel which allows easy correction or modification of the content being displayed.

To accomplish the abovesaid objects, this invention employs a novel electrode structure in which electrodes are formed on substrates disposed opposite each other with a discharge sealed gas space defined therebetween, and the electrodes are alternately connected to at least two phases of buses on the respective substrates. The electrodes alternately connected to the buses on each substrate are each disposed to have portions corresponding portions opposite adjacent pairs of the electrodes alternately connected to the buses on the other substrate. By switching the voltages to the four buses one after another, a discharge spot can be shifted between adjacent discharge points formed between the opposing parts of the electrodes of both substrates. Accordingly, one embodiment of this invention requires the connection of only two buses on each substrate, and hence easily eliminates the necessity of the so-called crossover of the electrodes.

DESCRIPTION OF THE PREFERRED EMBODIMENTS

Figure 1:
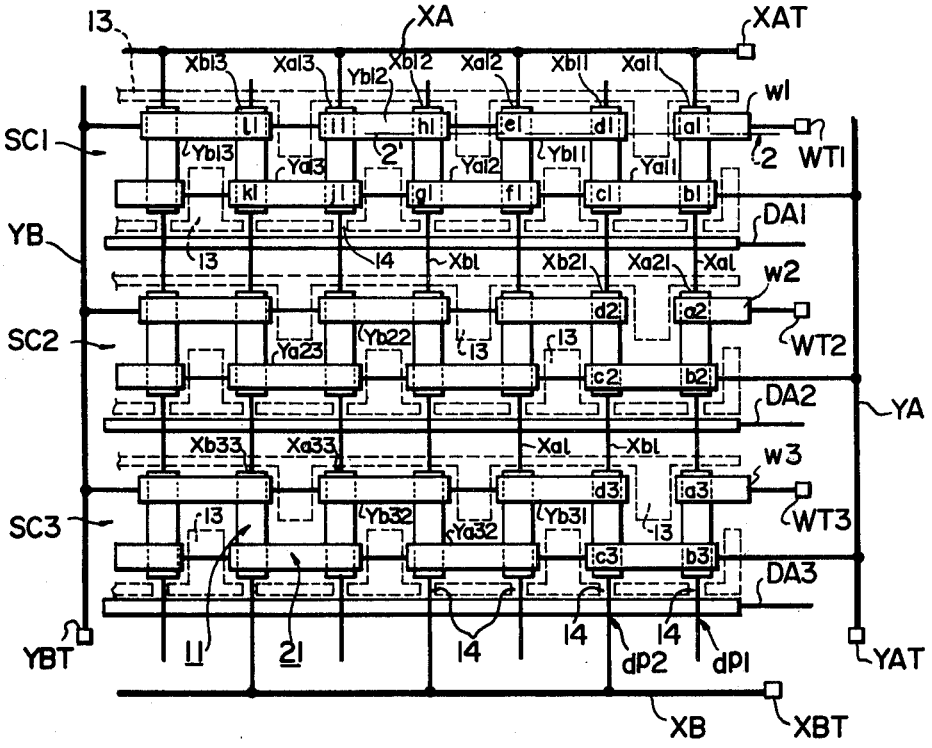
FIG. 1 is a schematic diagram explanatory of an electrode arrangement according to an embodiment of this invention.
Figure 2:
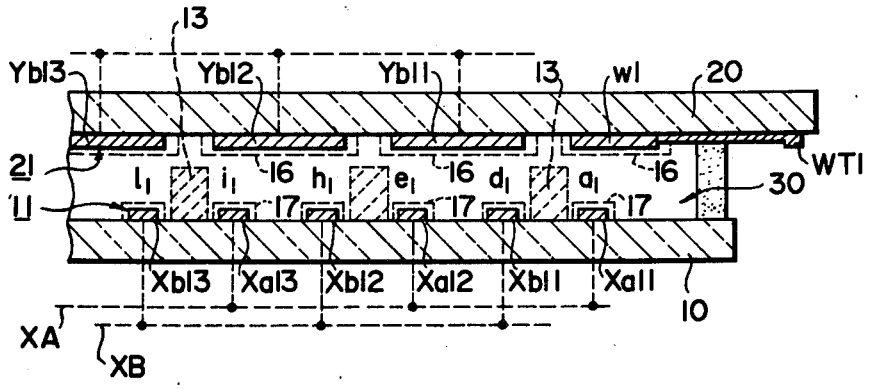
FIG. 2 is a cross-sectional view taken on the line 2–2' in FIG. 1.

In FIG. 1 there is illustrated an electrode arrangement of a gas discharge panel in accordance with an embodiment of this invention. For convenience of illustration, three parallel scanning channels SC1, SC2 and SC3 are shown. As is evident from FIG. 2 showing in section the principal part of the electrode arrangement along the line 2–2' in FIG. 1, each scanning channel includes a first electrode set 11 arranged on one substrate 10 and a second electrode set 21 on the other substrate 20. The electrode sets are disposed opposite each other across a discharge space 30 filled with anionizable gas.

The first electrode set 11 forming each scanning channel includes elongated electrodes X*aij* and X*bij* (i, j=1, 2, 3, . . .) arranged in parallel at substantially equal intervals. These electrodes are alternately connected to common buses XA and XB on the substrate 10, the electrodes Xaij connected to one bus XA forming a first electrode group and the electrodes Xbij connected to the other bus XB forming a second electrode group. The second electrode set 21 on the other substrate 20 is divided into electrode groups arranged along two lines extending across the first electrodes set 11 for each channel. The electrode of one of the two electrode groups of the second set 21 make up a third group of electrodes Yaij which are each disposed opposite to a pair of adjacent ones of the electrodes (X*a*11 and X*b*11, X*a*12 and X*b*12, . . . ) of the first and second electrode groups included in the first electrode set. The electrodes of the other electrode group of the second set make up a fourth group of electrodes Ybij which are each opposed to a pair of adjacent ones of the electrodes (Xb11 and Xa12, Xb12 and Xa13, . . . ) of the first and second electrode groups in a positional relationship spatially different in phase from the third electrode group. The third and fourth electrode groups are respectively connected to buses YA and YB on the same substrate 20.

The scanning channels SC1, SC2 and SC3 are provided at one end with write electrodes w1, w2 and w3 for defining write discharge points a1, a2 and a3. The write electrodes w1, w2 and w3 are disposed on the substrate 20 in such a manner as to be opposite the first electrodes Xa11, Xa21 and Xa31 of the first electrode set 11, respectively, and are connected to terminals WT1, WT2 and WT3, respectively. Thus, this embodiment of the gas discharge panel of this invention has two scanning operation terminals XAT and XBT on one substrate 10 and two scanning operation terminals YAT and YBT and the predetermined number of write electrode terminals WT on the substrate 20.

With such a panel structure, when a write pulse of a level exceeding a firing voltage is applied, for example, to the write electrode w1, a discharge spot is produced at the write discharge point a1 between the electrodes w1 and Xa11. By sequentially applying scanning voltages of predetermined levels to the electrodes of the two groups included in each of the first and second electrode sets, the abovesaid discharge spot can be shifted along the discharge points b1-c1-d1-e1, . . . that is along the meander scanning channel which connects adjacent discharge points using alternating ones of the electrodes of the two groups of both electrode sets 11 and 21. In the case of shifting the discharge spot, for example, from a discharge point h1 to the next one i1 by the scanning operation, the scanning voltage is applied across the electrodes Xa13 and Yb12 forming the discharge point i1 but, at the same time, this scanning voltage is also applied to the discharge point e1 on the opposite side of h1 through the common bus.

Since the third and fourth electrode groups are alternately spaced every two discharge points as described above, plasma coupling of the discharge points between adjacent ones of the separated electrodes, such as between e1 and h1, tends to become relatively loose, as compared with plasma coupling between adjacent discharge points having one electrode in common, such as between h1 and i1. Based on this phenomenon, there arises a difference in the firing voltage between these two types of adjacent discharge points. The firing voltage at the separated preciding discharge point, not having an electrode in common with the discharge spot, is higher than the firing voltage at the other discharge point having an electrode in common with the discharge spot. This is because a discharge spot usually spreads out in the lengthwise direction of the electrode, and the amount of electrons, ions and metastable atoms supplied from the discharge spot to the discharge point adjoining it in the lengthwise direction of the electrode, which amount is defined as the tightness of the plasma coupling or as the magnitude of the fire priming effect, is larger than the amount of electrons, ions and metastable atoms supplied to the discharge point of the separated electrode preceding the electrode currently activated. Consequently, the abovesaid adjoining discharge point with the electrode in common to the discharge spot has a lower firing voltage than the other above said separated discharge point of the preceding electrode. If the level of the scanning voltage is selected to be higher than the required firing voltage of the discharge point i1 and lower than a required firing voltage of the discharge point e1, even when scanning voltages of the same level are simultaneously applied to the adjacent discharge points i1 and e1 as described above, only the discharge point i1 is fired to provide directionality in the scanning.

To argument this plasma coupling effect of electrode separation to provide for enhanced stability and accuracy in the scanning operation, it is desirable to dispose barriers 13 between adjacent ones of the discharge points, as are indicated by the broken lines in FIG. 1. Since high accuracy is not required for patterning of these barriers, they can be formed relatively easily by screen-printing of a low-melting-point glass or the like on at least one of the substrates. Further, it is preferred that both ends of the individual electrodes of the third and fourth electrode groups have, for instance, curved configurations so that plasma coupling between adjacent discharge points may be as loose as possible.

Figure 3:
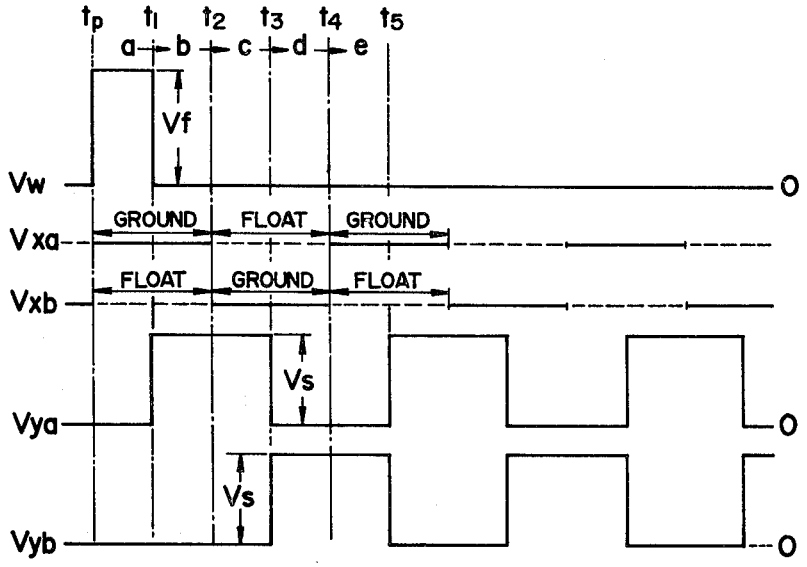
FIG. 3 is a diagram explanatory of a drive voltage waveform for the embodiment of FIG. 1.

An actual scanning operation is achieved by switching the application of scanning voltages to the buses one after another in such a manner as shown, for example, in FIG. 3. In FIG. 3, reference character Vw indicates a write voltage, and Vxa, Vxb, Vya and Vyb designate scanning voltages which are applied to the buses XA, XB, YA and YB, respectively. In this instance, the electrodes of the first and second electrode groups connected to the buses XA and XB, respectively, are driven as cathodes, while the electrodes of the third and fourth electrode groups connected to the buses YA and YB, respectively, are driven as anodes. For example, when a write voltage Vf is applied to the write electrode wl during the time $t_0$–$t_1$ while the bus XA is held at ground potential, a discharge spot is produced at the discharge point a1; and when a positive scanning voltage Vs is applied to the bus YA at the next timing $t_1$, the discharge spot shifts to the next discharge point b1 formed adjacent the discharge point a1 in a vertical direction. By floating the potential of the bus XA off putting ground potential and holding the bus XB to ground potential at time $t_2$, the discharge spot shifts in a lateral direction to the discharge point c1 formed on the same electrode Ya11 of the third electrode group as the discharge point b1. Then, when switching the scanning voltage Vs from the bus YA to YB at the time $t_3$ while holding the bus XB at ground potential, a discharge spot is produced at the adjoining discharge point d1 formed on the electrode Xb11 of the second electrode group. In this way, a discharge spot can be shifted in zigzag by alternately switching the positive scanning voltage to the third and fourth electrode groups serving as anodes while alternately putting to ground and the potential of the first and second electrode groups serving as cathodes.

Figure 4A:
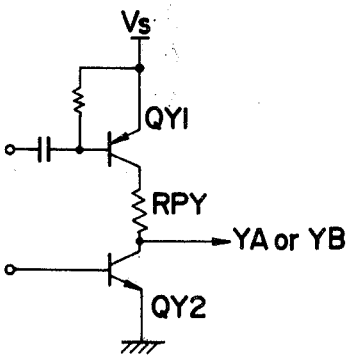
FIGS. 4A and 4B are circuit diagrams showing the principal parts of a drive circuit.
Figure 4B:
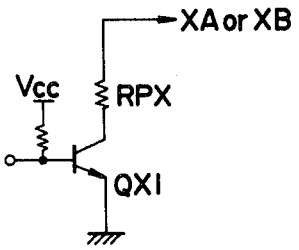

The switching of such scanning voltages can be easily effected by the employment of such switching circuits as shown in FIGS. 4A and 4B. FIG. 4A illustrates the structure of a drive circuit which is connected to the bus YA or YB of the electrodes of the third or fourth electrode group acting as anodes, and which includes, as principal elements, a pair of switching transistors QY1 and QY2 which are driven alternately with each other and a protective resistor RPY for limiting a discharge current. FIG. 4B shows the structure of a drive circuit which is connected to the bus XA or XB of the electrodes of the first and second electrode groups acting as cathodes, and which includes, as principal elements, a switching transistor QX1 for connecting the electrodes to the ground potential at required timings and a protective resistor RPX. With control of the inputs to these transistors by means of, for example, reversible counters or the like, the direction of shift of the discharge spot can be switched to right or left as desired.

Figure 5:
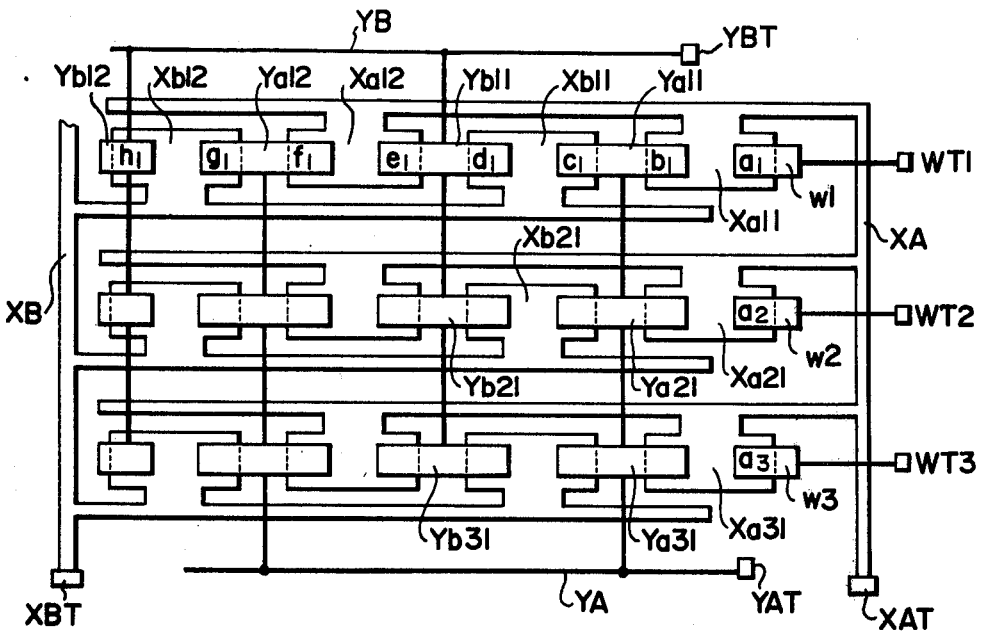
FIG. 5 is a schematic diagram explanatory of an electrode arrangement according to another embodiment of this invention.

FIG. 5 is an electrode arrangement diagram illustrating another embodiment of this invention, which is improved in that the discharge spot scanning channels, which are formed in a meander path in the embodiment of FIG. 1, are formed straight. In FIG. 5, parts corresponding to those in FIG. 1 are identified by the same reference characters. Each of the electrodes Xaij and Xbij of the first and second electrode groups and the electrodes Yaij and Ybij of the third and fourth electrode groups are respectively arranged in predetermined directions in such a manner as to create a partial overlap between adjacent ones of electrode pairs oppositely disposed. In other words, the electrode arrangement of the present embodiment takes such a form that the electrodes arranged along a meander path in FIG. 1 are disposed in a straight line in the lateral direction. With the electrode arrangement of FIG. 5, a discharge spot can be shifted in a straight line by the same method as described above with regard to FIG. 1. The electrodes of the first and second electrode groups, together with the connectors connecting them to the XA and XB buses, may be said to have an interdigitated arrangement along each shift channel.

As set forth above, this invention permits a marked simplification of the discharge spot scan or shift mechanism. In an actual display operation using such a mechanism, the following applications are possible.

A first application is to provide a display using the scanning discharge spot itself. With this method, a discharge spot is in every shift channel produced by applying the same write voltage to all of the scanning lines, and these discharge spots are then simultaneously shifted to the desired position in all of the channels to serve as a marker along an exterior scale, such as temperature or a like physical quantity which changes with the surroundings, or to provide a dial indication in a radio receiver or the like. In this case, a display panel is formed only with the scan mechanism and it is sufficient to construct a control circuit that stops the switching of the scanning voltage at a desired position in accordance with input information.

A second application is an application to the "SELF SCAN" type display panel referred to previously. For the panel structure in this instance, it is necessary to provide a third substrate having electrodes, for example anode electrodes for display in combination with the aforesaid two substrates so as to utilize the scanning discharge spot as a priming fire for producing a display discharge spot. In this application to such a case of combining three substrates in parallel and spaced arrangement anodes for display use are disposed opposite the the scanning electrodes Yaij and/or Ybij of the third and/or fourth electrode groups in such a manner that the anode electrodes or the third substrate can be selected individually. Further, in the substrate 20 carrying the Y electrodes Yaij and Ybij, there are selectively formed small holes corresponding to the scanning discharge points for coupling them with those for the display use which are formed between the scanning electrodes of the Y-axis side and the anode electrodes for the display use. A specific operative structure will become more apparent by referring to the aforesaid literature.

It is also possible as a third application to provide the abovementioned discharge points for the display use in the same plane with the scanning discharge points. In this instance, cathode electrodes for the display use are disposed on the substrate 20 to cross the electrode lead in connectors of the X electrodes on the other substrate 10 in opposing relation thereto. Thus, in the embodiment of FIG. 1, cathode electrodes for display are respectively disposed between adjacent ones of the scanning channels, as indicated by DA1 to DA3, to define display discharge points dp1, dp2, . . . between these display cathode electrodes and electrode leads Xal and Xbl of the scanning electrodes Xaij and Xbij, respectively. For coupling the scanning discharge points with the display discharge points in coordination with each other, there are formed coupling channels 14 which permit the passage of charged particles past the aforesaid barriers 13 indicated by the broken lines.

By selectively applying discharge voltages corresponding to display information signals to the display anode electrodes DAi one after another on a time shared basis in correspondence with the timing of scanning the discharge spot which serves as a priming fire, the display discharge points are selectively discharged to radiate one after another. By repeating the above operation together with scanning of the discharge spot providing the priming fire, a desired display this driving method can be provided. Further, if the opposing electrode surfaces are covered with dielectric layers at the display discharge points, it is possible to provide such a memory display as in an AC discharge panel. To prevent the discharge of the scanning discharge points from obstructing the display, the priming fire discharge points may be covered with an opaque mask on the side from which the display is viewed. Needless to say, it is also possible to provide such display anode electrodes to a scanning electrode arrangement as shown in FIG. 5.

A fourth application of the scan mechanism of this invention is such a structure that a desired display pattern is shifted with the scan mechanism itself. However, in a gas discharge panel of the direct discharge type in which a plurality of parallel-connected electrodes are disposed in direct contact with a discharge gas, it is impossible to produce discharge spots at a plurality of discharge points in one shift channel at the same time. Accordingly, such a gas discharge panel can usually achieve only a simple display using only one discharge point for each channel, as in the case of the abovesaid first application, or by a refresh display by a time sharing operation. However, if the discharge points are each isolated from adjacent ones by means of resistors, simultaneous lighting of a plurality of discharge points in one shift channel can be achieved. It is preferred that such resistors for the isolation of the discharge points are provided in such a form as to cover the display electrodes, as indicated by broken lines 16 in FIG. 2. The resistor cover layer 16 may be formed not only on each electrode surface but also uniformly on the entire area of the substrate surface, or may be coated on both of the opposing substrate surfaces on which the anodes and the cathodes are disposed. Moreover, it is further convenient for achievement of a low voltage drive if the electrodes of the third and fourth groups Yaij and Ybij driven as anodes are respectively covered with the resistor cover layer 16 as shown and if the surface of the electrodes of the first and second groups Xaij and Xbij driven as cathodes are respectively covered with secondary electron emissive resistors or dielectric layers 17 as shown. The resistor cover layer 16 may be a tin oxide (SnO) film or the like and the secondary electron emissive cover layer 17 may be a magnesium oxide (MgO) film or an evaporated film of a mixture of strontium oxide (SrO) and calcium oxide (CaO).

With the scan mechanism of this invention having such means for electrically isolating adjacent discharge points, it is possible to sequentially shift a discharge spot written by selecting the write electrodes w1, w2, . . . and to write new information for each cycle of the shift operation, such as in an embodiment with four buses, by which a character or like display pattern formed by the combination of discharge spots produced three discharge points along each channel can be shifted in accordance with the write information. The pattern for display thus written can be displayed in a stationary state at a desired position by stopping the switching of scanning voltages at a desired timing.

As is apparent from the above, the foregoing embodiments of this invention propose, as a discharge spot scan or shift mechanism, an electrode structure which does not require the cross-over techniques for the insulation of electrodes. Accordingly, it is possible to provide an inexpensive and highly efficient gas discharge panel which involves markedly simplified manufacturing steps and which has an enhanced quality.

Figure 7:
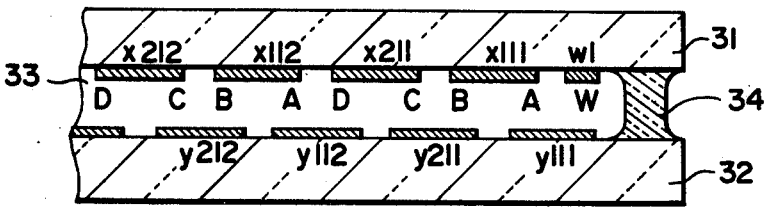
FIG. 7 is a cross-sectional view taken on the line A1–A1' in FIG. 6.
Figure 8:
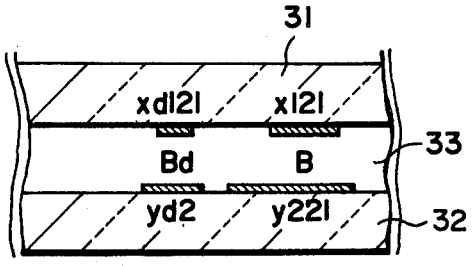
FIG. 8 is a cross-sectional view taken on the line A2–A2' in FIG. 6.
Figure 6:
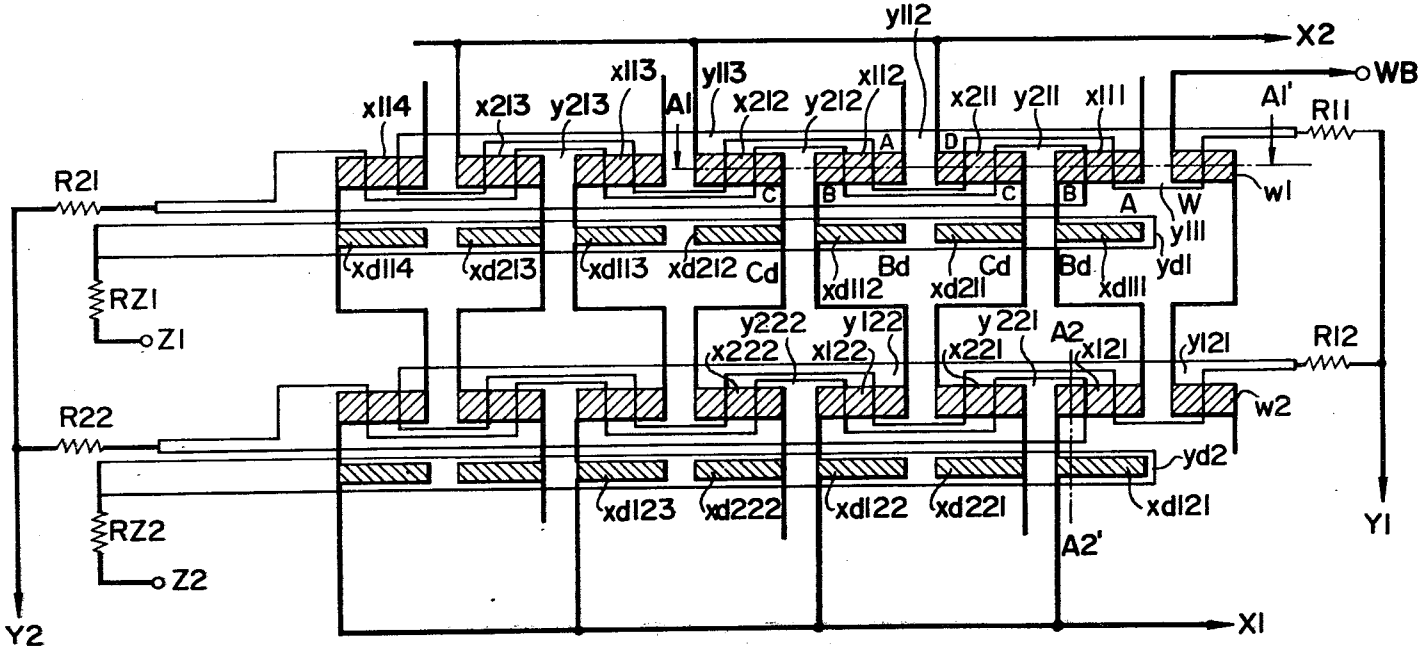
FIG. 6 is a schematic diagram explanatory of an electrode arrangement according to another embodiment of this invention.

FIG. 6 is explanatory of an electrode arrangement produced in accordance with another embodiment of this invention and FIGS. 7 and 8 are cross-sectional views taken along the lines A1–A1′ and A2–A2′ in FIG. 6, respectively. In the illustrated example, substrates 31 and 32 are disposed opposite each other and a neon or like discharge gas is sealed in a space 33 defined between the substrates 31 and 32 and the substrates 31 and 32 are sealed hermetically at their peripheries, as indicated by the seal 34. The substrate 31 has disposed thereon electrodes wl, x1li and x2li (l, i = 1, 2, 3, . . . in the following description) and electrodes xd1li and xd2li (indicated by hatching) disposed in straight lines, the electrodes wl being connected to a write bus WB, and the electrodes x1li and xd1li being connected to a bus X1 and the electrodes x2li and xd2li being connected to a bus X2. The substrate 32 has disposed thereon electrodes y1lj and y2lj (j = 1, 2, 3, . . .) and ydl, the electrodes y1lj being connected to a bus Y1 through resistors R1l, respectively, the electrodes y2lj being connected to a bus Y2 through resistors R2l, respectively, and the electrodes ydl being connected to terminals Zl through resistors RZl, respectively.

A discharge spot shift channel is formed with discharge points A to D respectively formed between the electrodes x1li and x2li and the electrodes y1lj and y2lj. A discharge spot produced at a write discharge point W between the write electrode wl and the electrode y1ll is shifted to the discharge points one after another. A display part is formed with discharge points Bd and Cd formed between the electrodes xd1li and xd2li and the electrode ydl, and a discharge spot is produced by the fire priming effect to provide a display.

Two-phase buses X1, X2 and Y1 and Y2 are provided on the substrates 31 and 32, respectively, and the electrodes are connected to them through connection conductors. The resulting structure is capable of shifting a discharge spot in a straight line and does not include any crossover parts of the electrodes, as is the case with the embodiment of FIG. 5.

Figure 9:
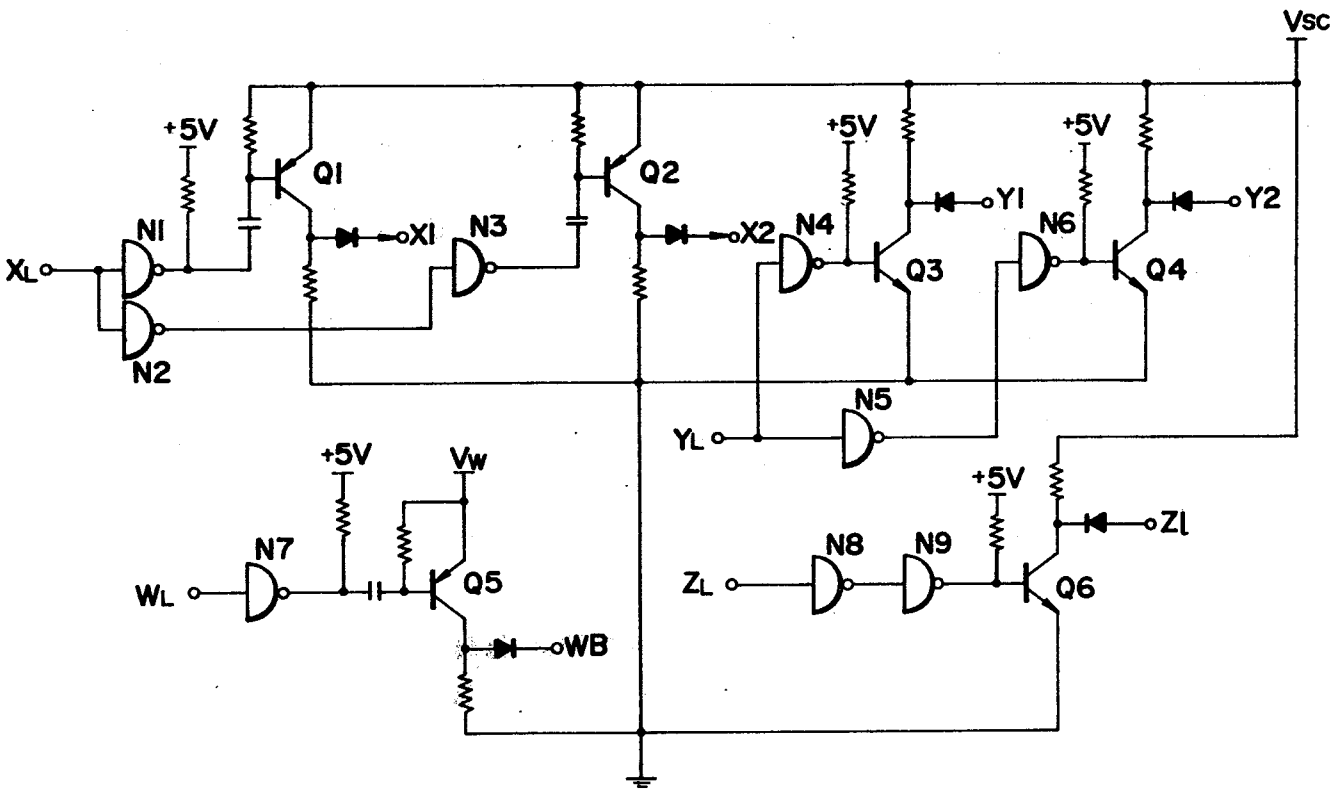
FIG. 9 is a circuit diagram showing the principal part of an example of drive circuit.
Figure 10:
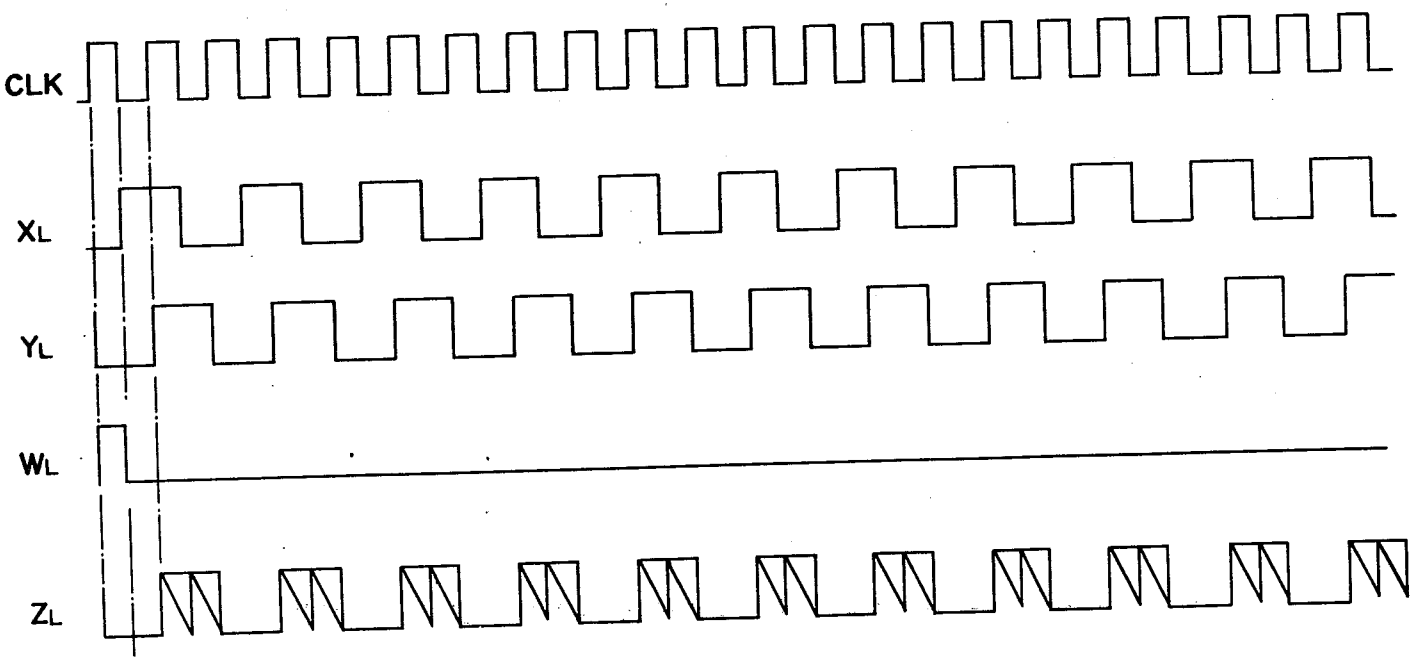
FIG. 10 is explanatory of input signals for the circuit of FIG. 9.
Figure 11:
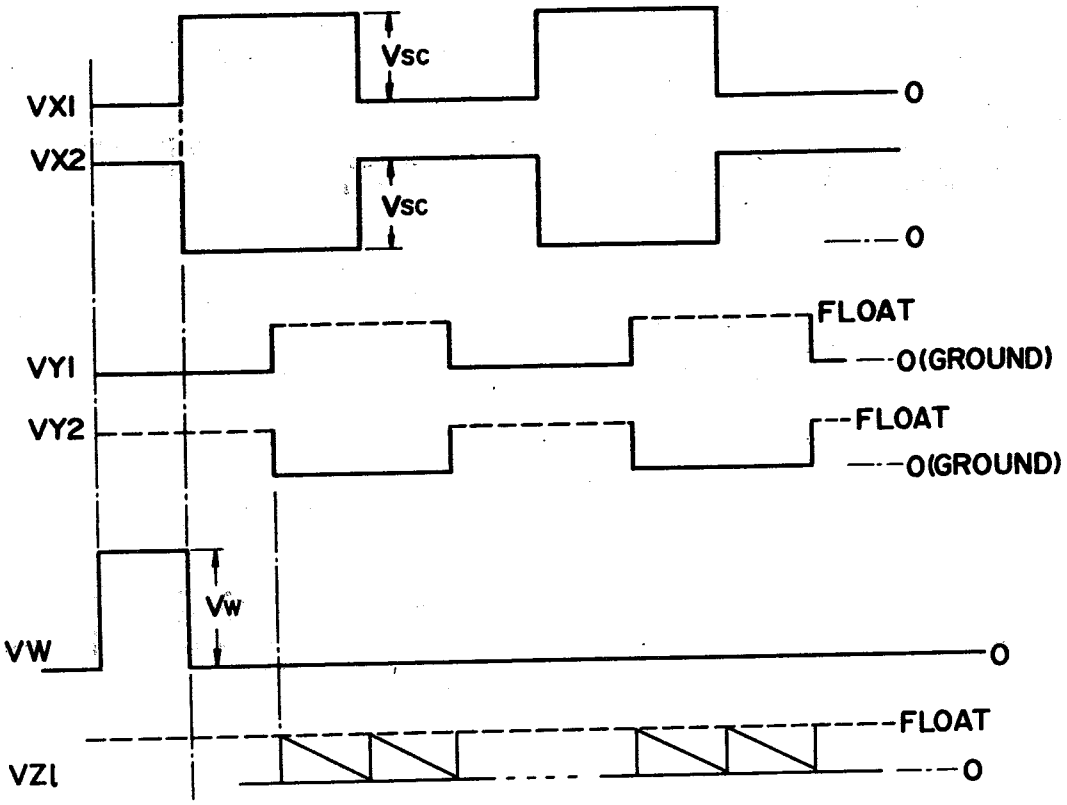
FIG. 11 is explanatory of voltage waveforms which are applied to buses connected to the output terminals of the drive circuit depicted in FIG. 9.

FIG. 9 illustrates the principal part of a drive circuit. Reference characters Q1 to Q6 indicate transistors and N1 to N9 designate NAND gates. FIG. 10 shows examples of the waveforms of input signals $X_L$, $Y_L$ and $Z_L$ and a clock signal CLK, and FIG. 11 shows voltage waveforms VX1, VX2, VY1, VY2, VW and VXl which are applied to the buses X1, X2, Y1, Y2 and WB and the terminal Zl, respectively line 17, in this case, the buses X1 and X2 being driven as anodes.

When a signal $W_L$ becomes "1," the transistor Q5 is turned ON to apply a write voltage Vw to the write bus WB, producing a discharge spot at the write discharge point W. At this time, since the signals $X_L$ and $Y_L$ are "0", the transistor Q1 is OFF, the transistors Q2 and Q3 ON and the transistor Q4 OFF. As a result of this, the bus X1 has ground potential, the bus X2 a potential Vsc, the bus Y1 has ground potential and the bus Y2 is put in its floating state. In FIG. 11, the broken lines show the floating states of the voltage waveforms VY1, VY2 and VZl.

Then, when the signal $X_L$ becomes "1," the transistor Q1 is turned ON and the transistor Q2 is turned OFF to apply the voltage Vsc to the bus X1, so that the discharge spot produced at the write discharge point W is shifted to the discharge point A. Next, the signal $Y_1$ also becomes "1" to apply the ground potential to the bus Y2 and put the bus Y1 in its floating state, shifting the discharge spot to the discharge point B. Thereafter, the discharge spot is sequentially shifted in the same manner as described above.

Making the signal $Z_L$ "1" at the moment of shifting the discharge spot to discharge point B, the transistor Q6 is turned ON to apply ground potential to the terminal Zl, so that the voltage Vsc is fed to a discharge point Bd to produce there a discharge spot by the fire priming effect.

Let Vf1 be the firing voltage at a discharge point adjacent to the discharge point where a discharge spot has been produced, and let Vfi be the firing voltage a at discharge point spaced i discharge points from the same lighted discharge point. The relationship these firing voltages is that Vfi>Vf1 and, as shown in FIG. 6, the discharge points of the shift channel have the same phase every four pitches. Accordingly, it is sufficient to select a shift voltage Vsc that has a relationship of Vf4>Vsc>Vf1 to the abovesaid firing voltages.

The resistors R1l, R2l and RZl (l = 1, 2, 3, . . .) are to limit discharge currents and their resistance values are so selected as to produce one discharge spot for one line.

By repetitively shifting the discharge spot in the shift channel and putting the terminal Zl to ground potential in correspondence to the position of the discharge spot being shifted, as described above, a discharge spot is produced in the display part due to the fire priming effect. With such an operation being achieved in synchronism with the discharge spot shift operation, it is possible to display predetermined information at a predetermined position. In this case, the display information is stored in an external memory and is read out therefrom in synchronism with shifting of the discharge spot and, be rewriting the external memory, the display content may be corrected in part or in whole with ease in the next shifting of the discharge spot.

Further, since the light from the discharge spot in the shift channel reduces the contrast of the display, it is preferred to form the electrodes of the shift channel with opaque electrodes and the electrodes of the display part with transparent electrodes. Alternatively, the resistance values of the resistors connected to the electrodes of the shift channel are selected to be higher than the resistors connected to the electrodes of the display part, thereby to decrease the amount of radiation of the discharge spots in the shift channels.

Figure 12:
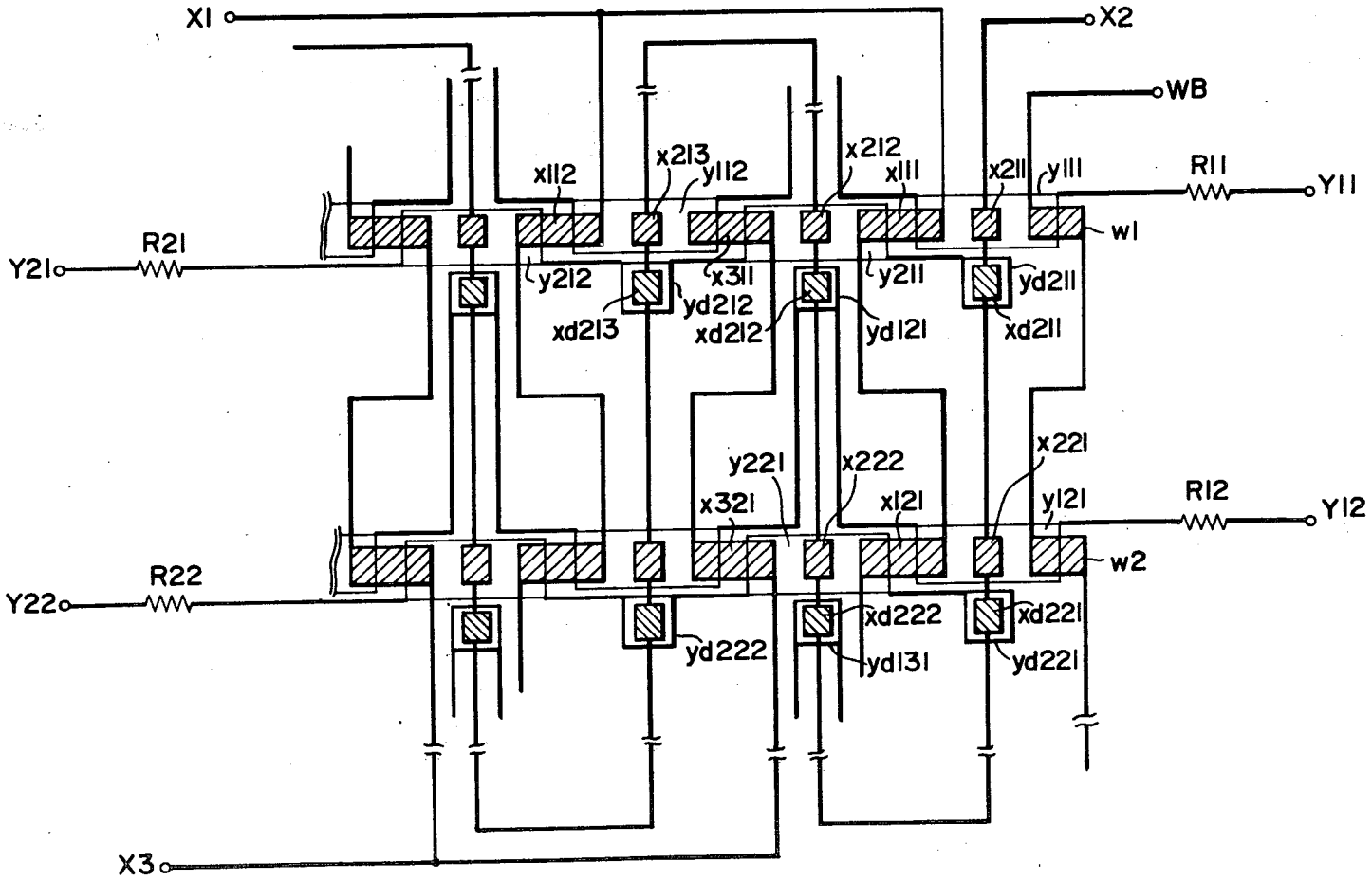
FIGS. 12, 13 and 14 are explanatory of electrode arrangements according to other embodiments of this invention.

FIG. 12 is explanatory of an electrode arrangement produced in accordance with another embodiment of this invention, in which three-phase buses X1 to X3 and two-phase buses Y1l and Y2l are provided. In this embodiment the leads connecting each of the buses X1 and X3 to the corresponding discharge cell electrodes as shown may be refered to as having a comb arrangement, with the two combs being interdigitated, whereas the lead connecting the bus X2 to the respective electrodes may be referred to as a meandor connector. A discharge spot shift channel is formed with electrodes x1li, x2li and x3li, electrodes y1li and y2li and write electrodes wl, and a display part is formed with electrodes xd2li, yd1kj and yd2lj (l, i, j, k, = 1, 2, 3, . . .). For example, when a discharge spot is shifted to a discharge point formed between the electrodes x211 and y111, if the bus Y21 is made equipotential to the ground, a discharge spot is generated by the fire priming effect at a discharge point between the electrodes xd211 and yd211. When the discharge point is shifted to a discharge point between the electrodes x212 and y211, if the bus Y12 is made to have ground potential, a discharge spot is produced by the fire priming effect at a discharge point between the electrodes xd212 and yd121.

As described above, by selecting the buses at the side at the shift channels when they are idle during the discharge spot shift operation, a discharge spot can be generated in the display part to provide a display.

Figure 13:
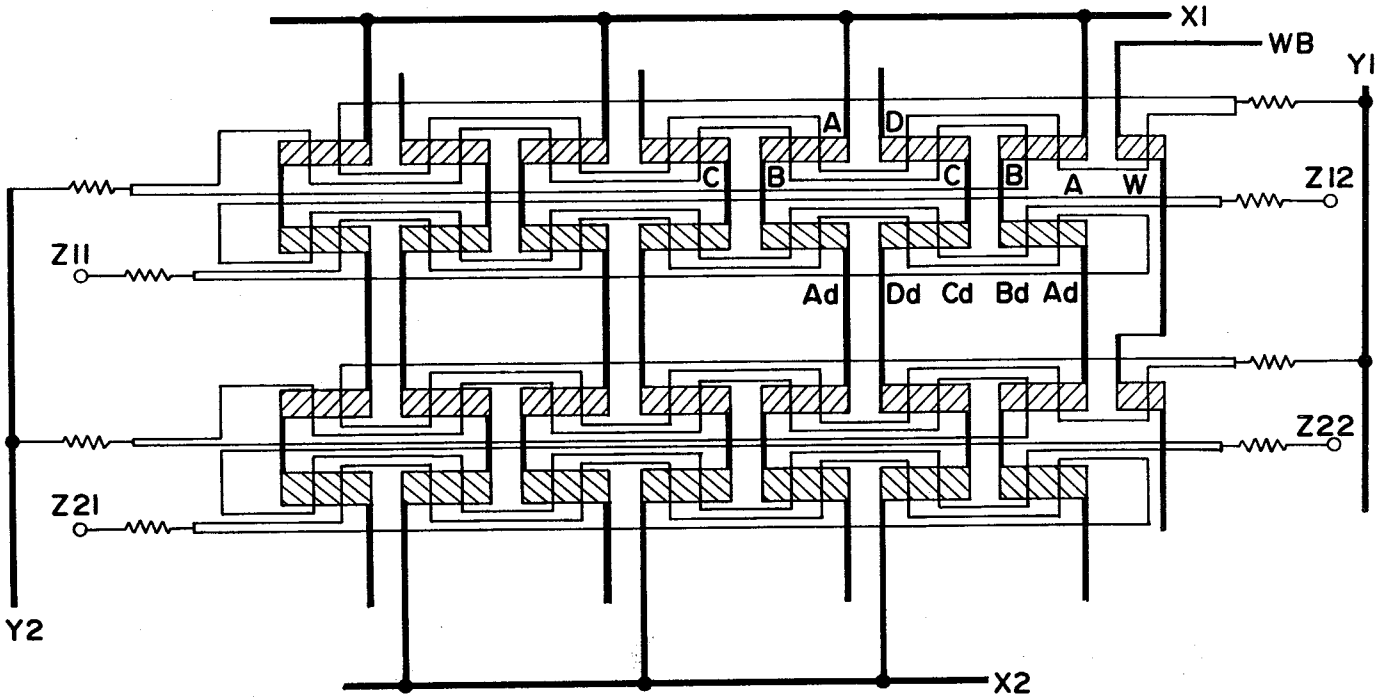

FIG. 13 illustrates another embodiment of this invention in which the discharge points of the shift and display parts have a one to one correspondence to each other. By setting the terminal Zl1 potential to ground when a discharge spot is shifted to a discharge point A or D on an electrode connected to the bus Y1, a discharge spot can be produced at a discharge point Ad or Dd of the display part. Similarly, by making the terminal Z12 have the ground potential when discharge spot is shifted to a discharge point B or C on an electrode connected to the bus Y2, a discharge spot can be generated at a discharge point Bd or Cd of the display part. A character or the like can be displayed by a combination of discharge spots produced in the display part. In this embodiment, since the pitch of discharge points of the display part is small, a high resolution display can be obtained easily.

As described above, since the present embodiment is of the DC discharge type, the drive circuit is simple and the electrodes forming the discharge spot shift part are connected to pluralities of buses on each substrate, respectively, without crossing one another, so that the electrode structure can be easily manufactured with small electrode pitch. Further, the display part is disposed in side-by-side relation to the shift part without requiring the provision of any barriers between them, and a display can be provided by selectively producing discharge spots on the display part in synchronism with the discharge spot shift.

Figure 14:
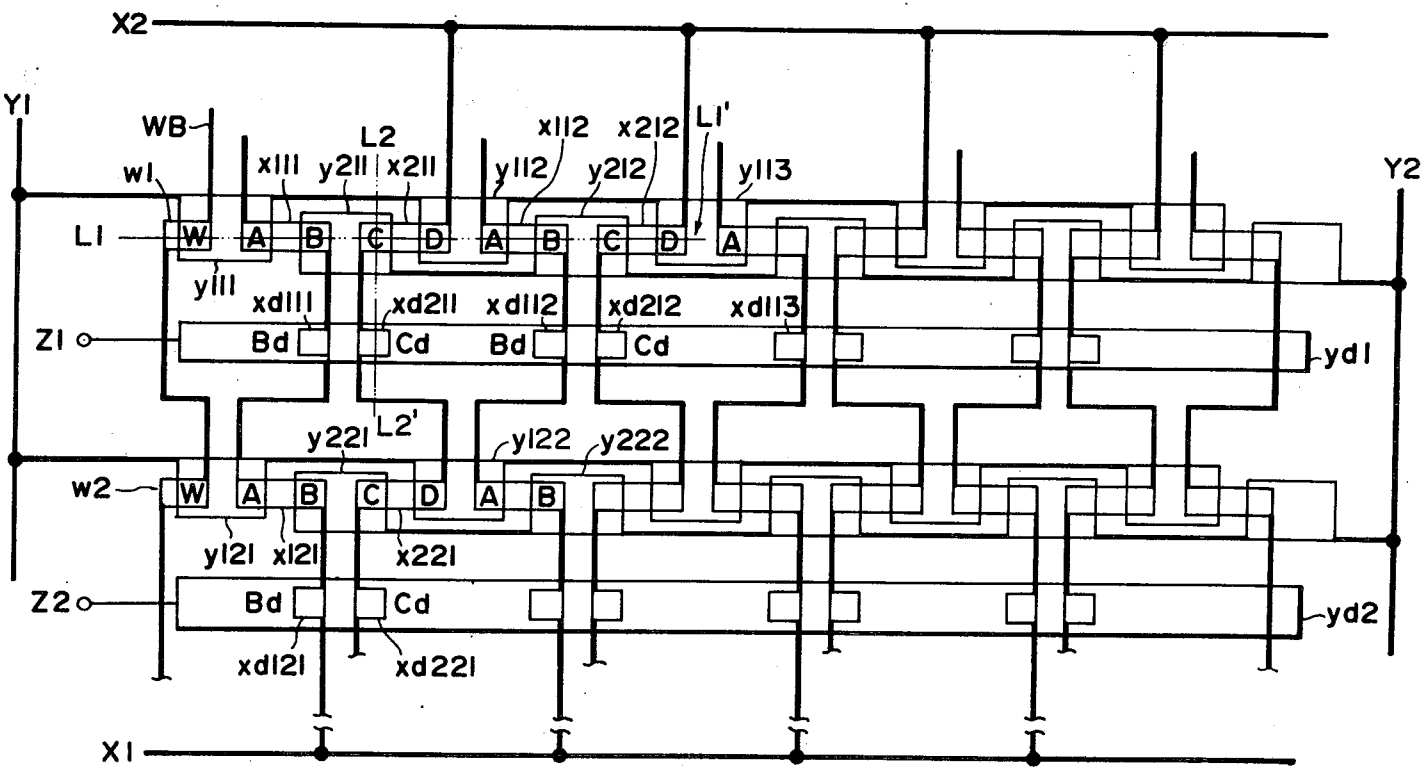
Figure 15:
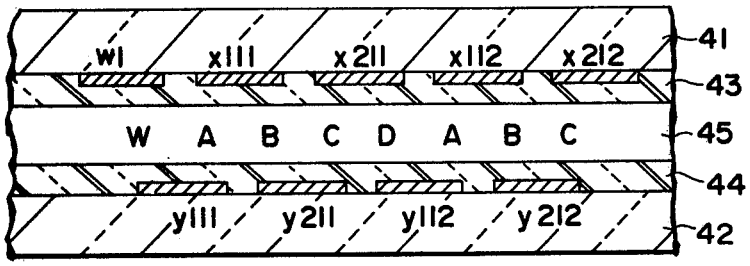
FIG. 15 is a cross-sectional view taken on the line L1–L1' in FIG. 14.
Figure 16:
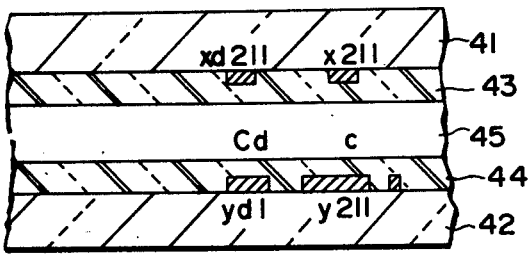
FIG. 16 is a cross-sectional view taken on the line L2–L2' in FIG. 14.

FIG. 14 is explanatory of an electrode arrangement produced in accordance with another embodiment of this invention and FIGS. 15 and 16 are cross-sectional views taken on the lines L1–L1′ and L2–L2′ in FIG. 14, respectively. On substrates 41 and 42, made for instance of glass, there are provided pluralities of buses and electrodes and the electrodes are respectively covered with dielectric layers 43 and 44 as of a low-melting-point glass. The substrates 41 and 42 are disposed opposite each other with a neon or like discharge gas in the sealed space 45 defined therebetween. The substrate 41 has arranged thereon buses X1 and X2, electrodes x1li, x2li, xd1li and xd2li (l, i = 1, 2, 3, . . .) connected to the buses, respectively, and write electrodes wl connected to a write bus WB, while the substrate 42 has arranged thereon buses Y1 and Y2, electrodes y1lj and y2lj (j = 1, 2, 3, . . .) and electrodes ydl connected to terminals Zl.

Discharge spot shift parts are each formed with a write discharge point W defined between the write electrode wl and the electrode y1ll and discharge points A to D between the electrodes x1li and x2li and the electrodes y1li and y2li. Display parts are each constituted with discharge points Bd and Cd respectively formed between the electrodes xd1li and xd2li and the electrode ydl. The discharge points of the display part are positioned at such locations where the fire priming effect are produced by a discharge spot sequentially shifted in the shift part, and by selectively utilizing the fire priming effect, a discharge spot is generated at the discharge point of the display part.

Figure 17:
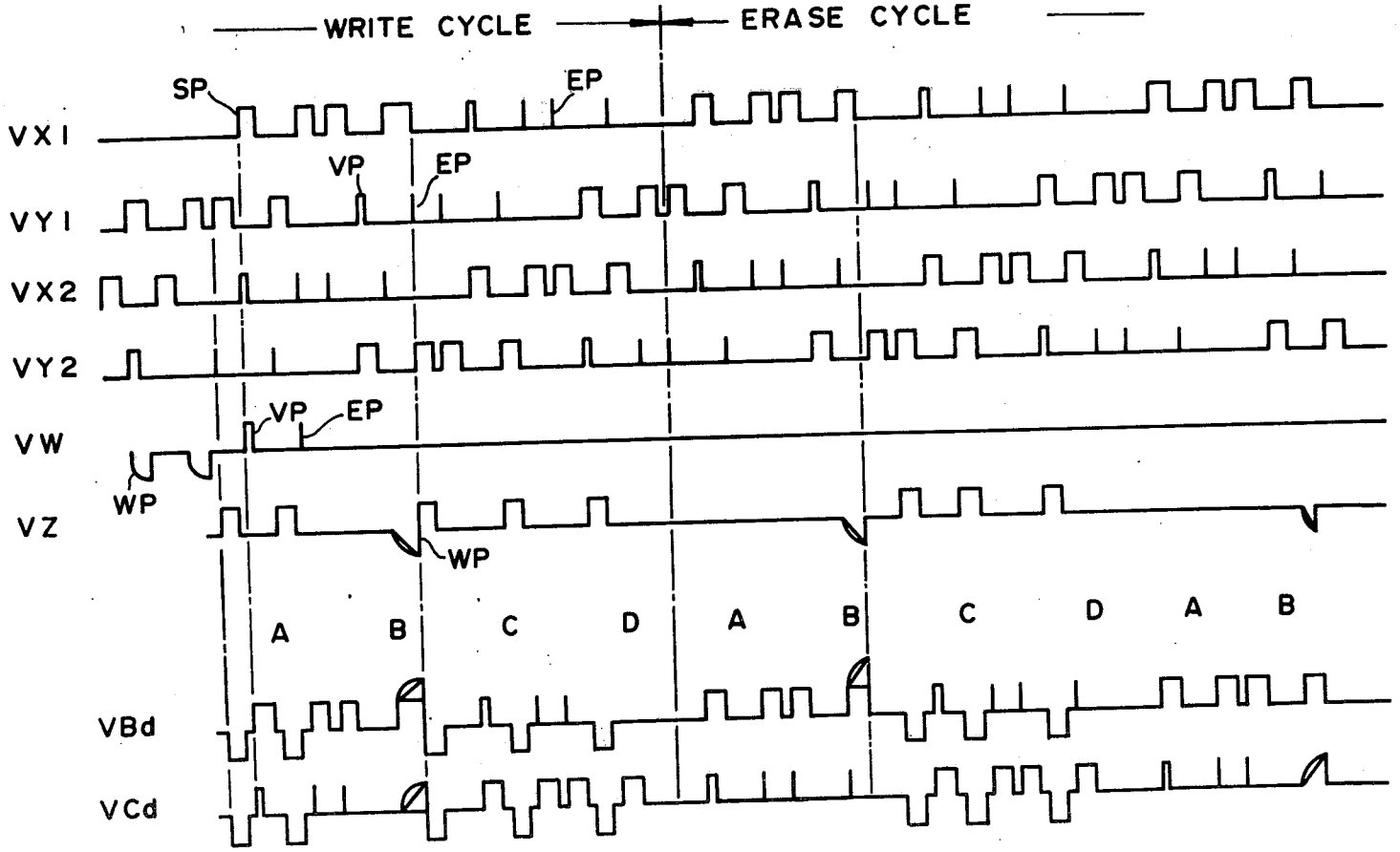
FIG. 17 is explanatory of drive waveforms employed in the embodiments shown in FIGS. 14, 15 and 16, respectively.

FIG. 17 illustrates examples of drive waveforms. Reference characters VX1, VX2, VY1, VY2 and VW indicate pulse voltage waveforms which are applied to the buses X1, X2, Y1, and Y2 and the write bus WB, respectively; VZ designates a pulse voltage waveform which is selectively applied to the terminal Zl; VBd and VCd identify pulse voltage waveforms which are applied to the discharge points Bd and Cd of the display part, respectively; SP denotes a shift pulse; VP represents an overlap pulse; EP shows an erase pulse; and WP refers to a write pulse. The shift pulse SP, the overlap pulse VP and the erase pulse EP have pulse widths of 5 to 15 μS, 0.3 to 5 μS and 0.3 to 3 μS, respectively.

At first, a write cycle will be described. The write pulse WP is applied to the write bus WB in a manner to provide a voltage higher than the firing voltage of the write discharge point W, producing a discharge spot at the write discharge point W. Then, when the overlap pulse VP is applied to the write bus WB and the shift pulse SP to the bus X1, space charges, metastable atoms, etc. resulting from discharge generated at the write discharge point W spread out to the discharge point A to reduce its firing voltage, so that a discharge spot is also produced at the discharge point A. Next, the erase pulse EP is applied to the write bus WB to erase the discharge spot at the write discharge point W.

Then, the shift pulse SP is applied to the bus Y2 to shift the discharge spot to the discharge point B and, thereafter, the discharge spot is sequentially shifted in the same manner. When the discharge spot is shifted to the discharge point B, if the write pulse WP opposite in polarity to the shift pulse SP is applied to the terminal Z1, a discharge spot is produced at the discharge point Bd due to the fire priming effect by the discharge spot at the discharge point B. No spot is generated at the discharge point Bd on which the fire priming effect is not produced.

The pulse voltages VBd and VCd, are applied to the discharge points Bd and Cd respectively, which are disposed close to each other. Once a discharge spot has been produced at the discharge point Bd, it reciprocates between the discharge points Bd and Cd in response to shifting of the discharge spot in the shift part. Further, even if the write pulse WP is applied to the terminal Zl for generating a discharge spot at another discharge point of the display part, the write pulse is applied to the already-written discharge point in the opposite polarity from a wall voltage set up by discharge, so that there does not occur any problem.

As described above, a discharge spot can be produced at a discharge point of the display part by shifting a discharge spot in the shift part and applying a write pulse to the terminal Zl in correspondence to the shift position of the discharge spot and input information can be written and displayed without shifting the display content in the same manner as in the case of sequentially writing information from one end of a line. Since the written content is stored by wall charges on the dielectric layers 43 and 44, shifting of the discharge spot in the display part may be required only once for one picture and, after written, the input information can be continuously displayed with the discharge spots at the discharge points of the display part by the pulse voltages applied to the buses X1 and X2 and the terminal Zl. Accordingly, the gas discharge panel of this invention dispenses with an external memory and enables a high-brightness display, as compared with the DC discharge type panel.

An erase cycle for erasing one part of the display content already written is as follows. In the shift part, the discharge spot shift is carried out in the same manner as in the above, while in the display part the write pulse WP is applied to the terminal Zl at the timings of shifting the discharge spot to the discharge points of the shift part which are adjacent the discharge points of the display part. In this case, the shift pulse SP is not applied to the terminal Zl prior to the application of the write pulse WP.

With a strong discharge produced by the write pulse WP at the discharge point Bd, wall charges at the adjoining display discharge points are erased and, due to the sharp fall of the write pulse WP, a self erase takes place at the discharge point Bd. In those discharge points of the display part which are not adjacent the discharge spot of the shift part, no wall charge is erased due to distance from the discharge, and consequently no erase operation is achieved. After such an erase operation, one part of the display content can be rewritten by the operation of the write cycle described above.

Also, one part of the display content may be erased in the following manner. When the discharge spot of the shift part is shifted to the position corresponding to the position where the display content is to be erased, the discharge spot is maintained continuously at the same discharge point for several to some dozen cycles. In such an instance, wall charges at the adjoining discharge point of the display part are neutralized by space charges to disappear, thus achieving the erase operation. At the other discharge points of the display part, since they are not adjacent the discharge spot of the shift part, their wall charges do not disappear and the written content is held.

Instead of writing in the display part while shifting one discharge spot in one line, it is also possible to shift a plurality of discharge spots as a display pattern in the shift part, as is the case with the conventional self-shift type gas discharge panel, and to write this information pattern into corresponding lines in the display part.

For decreasing the brightness of the discharge spots in the shift part, it is preferred that the electrodes of the shift part be opaque. Although this invention has been described in connection with the case where the shift part has the AC discharge type structure in which the electrodes are covered with dielectric layers, the shift part may also be formed to have the DC discharge type structure in which the electrodes are exposed in the discharge gas space.

The drive circuit may be of the structure already proposed. For example, the shift part is driven with the structure for the shift operation of a ME (Meander Electrode) type self-shift gas discharge panel proposed in Japanese Pat. application No. 144142/76, and the display part is driven with such a structure which effects a write operation when the content of a counter for counting the shift operation cycle and write position information match with each other.

The foregoing embodiments have described the panel structure in which the write electrodes for starting the discharge spot for scan or shift is disposed at the right-hand side of the panel and the discharge spot is shifted from right to left. In view of the order of writing characters, however, it is preferred in practice to place the write electrode at the left-hand side of the panel and to shift the discharge spot from left to right.

Figure 18A:
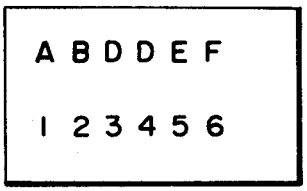
FIGS. 18A to 18E are explanatory of the operation for partly correcting the content displayed.
Figure 18B:
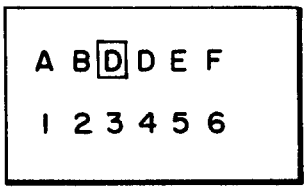
Figure 18C:
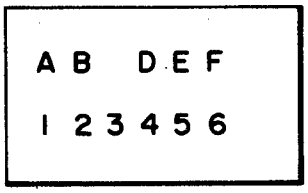
Figure 18D:
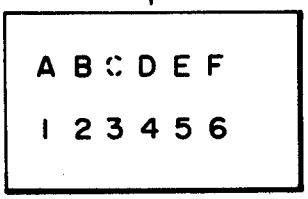
Figure 18E:
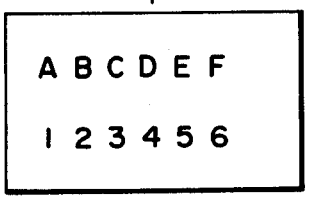

With such a structure as set forth above, a partial correction of the display content is carried out in the following manner. For example, in the case where characters ABDDEF have been written as shown in FIG. 18A, if the character "D" in a square in FIG. 18B is to be substituted with "C," discharge spots of the same character pattern as the character to be erased or discharge spots over the entire area of one character are shifted in the shift part and, at the position of the character to be erased, the character "D" is erased by the write operation in the display part or neutralization of wall charges in the display part, as depicted in FIG. 18C. Then, discharge spots of the pattern of the character "C" are shifted in the shift part and when the discharge spots are shifted to the position indicated by "C" in the broken line in FIG. 18D, a write pulse is applied in the display part. Thus, a desired character in one line can be corrected, as shown in FIG. 18E.

In the driving of the gas discharge panel having the shift part and the display part explained previously with respect to FIGS. 14 to 16, considerations should be given to the drive waveform to be applied to the display electrodes so as to prevent an erroneous write. That is, the magnitude and margin of the write pulse which is applied to a display discharge point selected in accordance with the position of a shifted discharge spot, are usually determined in dependence upon the distance between the shift discharge point serving as a charge source cell and the selected display discharge point and the distance between the selected discharge point and the adjoining display discharge point. However, since these factors are already determined by design specifications of the panel, it is desirable to consider other means for improving the write margin.

Figure 19:
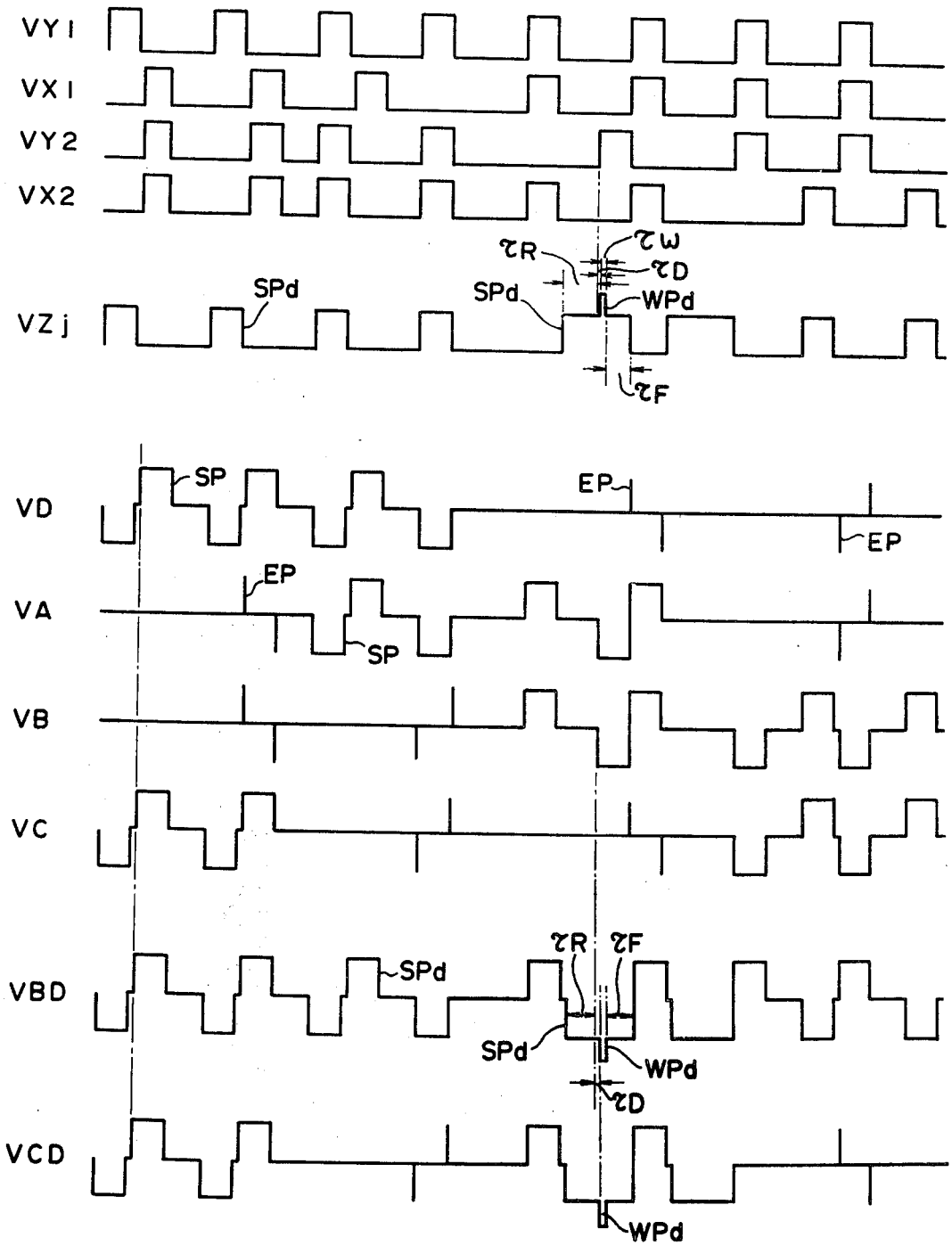
FIG. 19 shows other drive waveforms for driving the panel depicted in FIG. 17.

FIG. 19 shows an example of improved drive waveforms for the abovesaid purpose. Reference characters VY1, VX1, VY2, VX2, VZ, VBd and VCd correspond to those in FIG. 17, respectively. Reference characters VA, VB, VC and VD indicate composite voltage waveforms which are respectively applied through buses to four-phase discharge cells for shifting. The erase pulse EP of small pulse width is applied based on a phase difference between two pulse voltages which are applied to two opposed electrodes. The features to be noted in the drive waveforms of FIG. 19 are the pulse width and the timing of a write pulse WPd which is applied to the display electrode in correspondence to an information signal. The write pulse WPd is superimposed on a sustain pulse SPd as a narrow-width pulse which is delayed behind the rise of the sustain pulse SPd by $\tau R$ and has a pulse width $\tau W$. The narrow-width write pulse WPd is applied in such a manner as to rise a time $\tau D$ after the rise of the shift pulse SP, which is applied through the bus Y2 to a B phase shift discharge point serving as a charge source cell, and to fall a time $\tau F$ before the fall of the sustain pulse SPd. The reason for providing the delay $\tau R$ between the rise of the sustain SPd and the rise of the write pulse WPd is to prevent the write pulse WPd from exerting an influence on the display discharge point at the position where information is already written. Since wall charges at the display discharge point in the ON state are reversed in polarity by the sustain pulse SPd prior to the rising of the write pulse WPd, the display discharge points in the ON state are not affected by the write pulse WPd of a high level. The time delay $\tau R$ is selected to range from 1 to 20 μsec., preferably, 3 to 10 μsec. The delay time $\tau D$ of the write pulse WPd behind the shift pulse SP is provided for the most efficient supply of charges in view of a delay in the generation of a discharge at the shift discharge point. The delay time $\tau D$ is selected to the range of 0 to 3 μsec., preferably, 0 to 1 μsec. The pulse width $\tau W$ of the write pulse WPd is desired to be 0.2 to 5 μsec., preferably 0.3 to 3 μsec. This time must be longer than the delay time of the discharge at the selected display discharge point but if the pulse width of the write pulse WPd exceeds the above said optimum range, the possibility of causing a misfire at a non-selected display discharge point increases and the write margin decreases abruptly. Where the pulse width $\tau W$ of the write pulse WPd is in the range of 0.3 to 3 μsec., even if the non-selected discharge point misfires, the time for growing wall charges is insufficient, so that no faulty display results. The sustain pulse period $\tau F$ following the fall of the write pulse WPd serves to promote the growth of a write discharge produced at the selected display discharge point and to ensure the setting up of wall charges. The time $\tau F$ is preferred to be 2 to 10 μsec. With the write operation for the display discharge point using such drive waveforms as shown in FIG. 19, the operation margin is markedly improved.

As described in the above embodiments, the shift part and the display part are disposed adjacent to each other and information can be written in the display part by the fire priming effect of a discharge spot shifted in the shift part, so that the content thus written does not shift and provides a stable display which is easy to recognize. Further, in the above embodiments, no cross-over parts for the electrodes are required and since no two-layer panel structure is employed, and further no barriers are required. Accordingly, the panel structure is markedly simplified. The number of phases of the buses may be larger than the two phases two by in various above said embodiments.

Moreover, if at least the display part has the AC discharge type construction, written information can be stored and displayed and, no external memory is needed and since the written content can be displayed by a discharge spot successively generated, a high-brightness display is possible. The discharge points of the shift and the display part have a two to one correspondence to each other in the above embodiments, but they may also have one to one correspondence. Other various modifications are possible.

In the embodiments shown in FIGS. 1 to 13, it is possible to cover the electrodes with a dielectric layer 500Å to 5 μm in thickness. However, a thin dielectric layer may be formed to cover one or both of the opposed electrodes in, for example, the drive circuit shown in FIG. 9.

Figure 20:
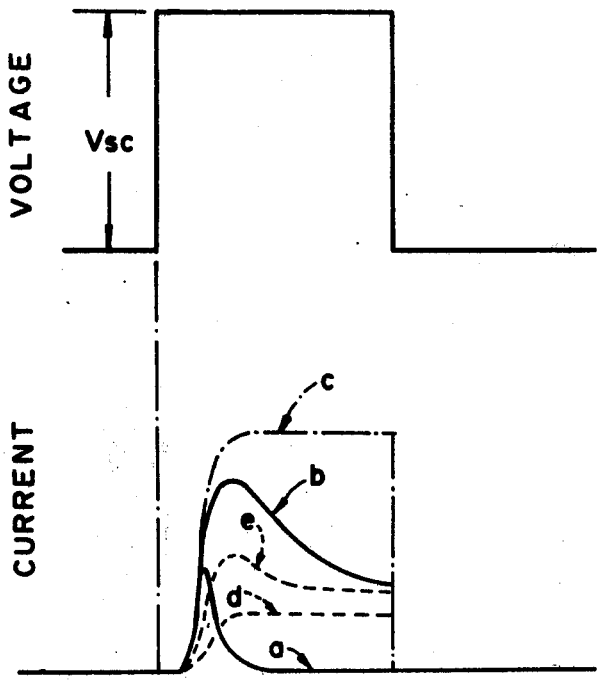
FIG. 20 is explanatory of discharge current characteristics due to a dielectric layer and a limiting resistance.

The discharge current characteristic of a discharge point differs with the presence or absence of a dielectric layer deposited on the electrode and on its thickness. This will be described in respect of FIG. 20. Where a voltage Vsc is applied, a discharge current differs with the structure of a discharge point and the magnitude of a limiting resistor. In the case where the dielectric layer on the electrode has a thickness of several ten μm, the AC discharge type characteristic indicated by a results and no limiting resistor is needed. If the dielectric layer is formed as thin as several μm, the discharge current increases, as indicated by the curve b. Where the dielectric layer is omitted to expose the electrode in the discharge gas space, the discharge current is finally limited by the limiting resistor, as indicated by the curve c.

In the case where the dielectric layer is formed thin and the limiting resistor is provided, if the limiting resistor has a large resistance, such a current as indicated by the curved d flows and if the limiting resistor has a small resistance, such a current as indicated by the curve e flows.

In the present embodiments, the dielectric layer is formed thin and a discharge spot is shifted using the same drive waveform as in the case of the DC discharge type structure. Accordingly, advantages of the DC discharge type and the AC discharge type can be effectively utilized.

Further, since the dielectric layer is employed, when a discharge spot has once been generated at a discharge point, wall charges are stored on the dielectric layer of the discharge point and the voltage for producing the next discharge spot must be increased in some cases. Accordingly, it is desirable to apply an erase pulse to the previous site of a discharge spot after completion of shifting of the discharge spot to the adjacent cell in the shift part. In this case, a single erase pulse may be applied but it is effective to apply the erase pulse in combination with one or two pulses. For avoiding the influence of the wall charge, it is also a suitable method to invert the polarity of a voltage for shift of a discharge spot to an odd-numbered cell of shift channel from the polarity of a voltage for shift to an even-numbered cell. Moreover, since the discharge spot shift in the shift part reduces the contrast of a display, it is desirable to make the electrodes of the shift part opaque and the electrodes of the display part transparent. Also, it is possible to reduce the intensity of a discharge spot in the shift part by selecting the resistances of the resistors R1l and R2l to be larger than the resistor RZl in FIG. 6.

Figure 21:
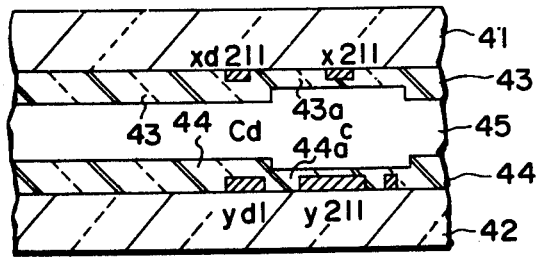
FIG. 21 is a cross-sectional view of the embodiment of this invention shown in FIG. 14, taken along the line L2–L2'.

In the present embodiments, the opposed electrodes of the shift and the display part may be respectively covered with dielectric layers and actuated as DC discharge types, but it is also possible to form a thin dielectric layer on either one of the opposed electrodes. Also, it is possible to cover either one of the opposed electrodes of the shift and the display part with a thick dielectric layer and to cover the other electrode with a thin dielectric layer or omit it. In such a case, the electrode covered with the thick dielectric layer is driven as the AC discharge type electrode and the other electrode as the DC discharge type one.

Where the shift and the display part are driven as DC and AC discharge type, respectively, if the electrode arrangement of FIG. 14 is employed, its cross-sectional views taken on the lines L1–L1′ and L2–L2′ in FIG. 14 are such as depicted in FIGS. 15 and 21, respectively. That is, the thicknesses of dielectric layers 43*a* and 44*a* on electrodes forming the shift part, for example, x211 and y211, are selected to range from 500Å to 5 μm and the thicknesses of dielectric layers 43 and 44 on electrodes forming the display part, for instance, xd211 and yd1, are selected to range from 2 to 150 μm, and preferably from, 5 to 15 μm. The dielectric layers 43, 43*a*, 44 and 44*a* in the illustrated example can also be each formed to include a sputtering-resistant protective layer of an alkaline earth metal oxide or rare earth oxide, as in the foregoing embodiments.

Figure 22:
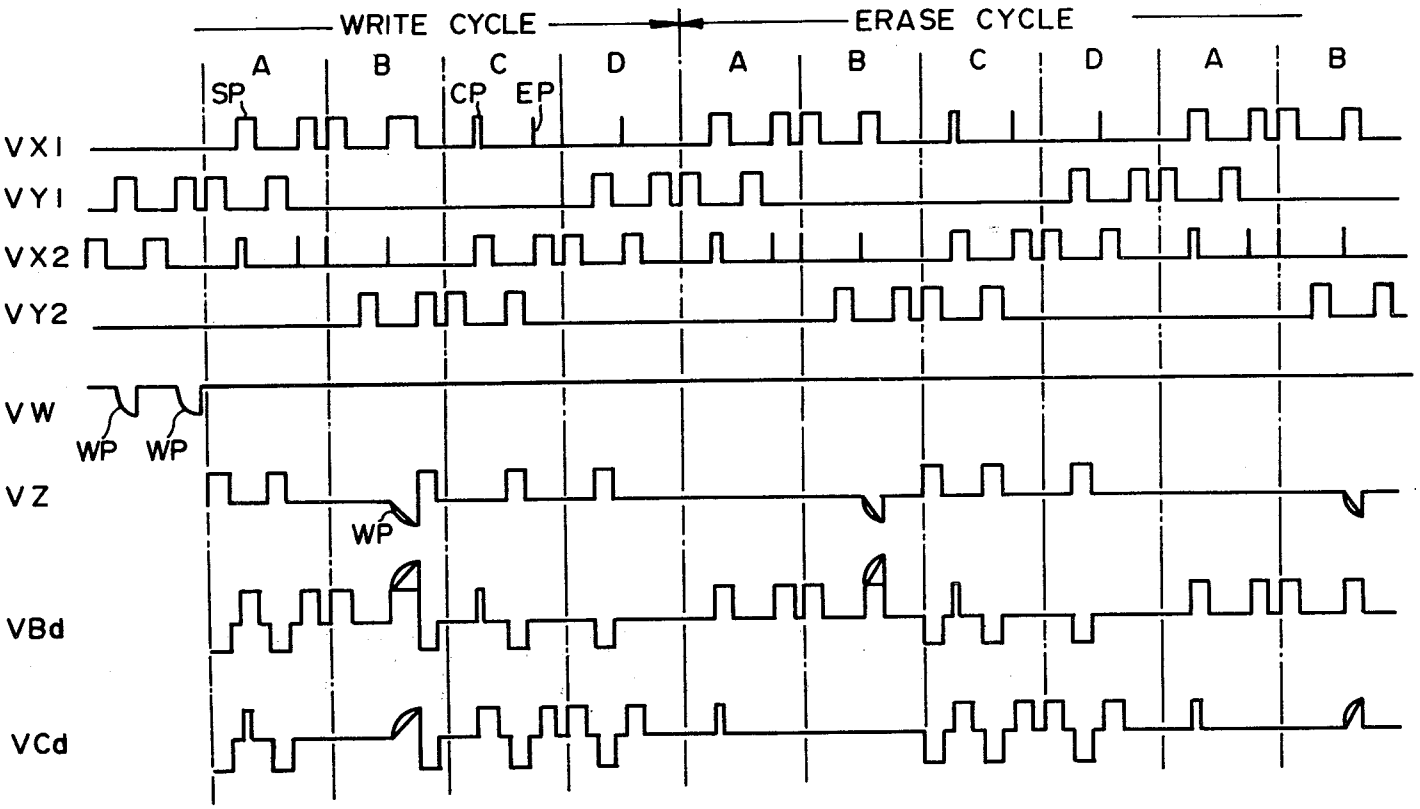
FIG. 22 is explanatory of drive waveforms used in the embodiment of FIG. 21.

FIG. 22 illustrates an example of the drive waveform. Reference characters VX1, VX2, VY1, VY2, VW and VZ indicate voltage waveforms applied to the buses X1, X2, Y1, Y2 and WB and the terminal Zl, respectively, and VBd and VCd designate voltage waveforms applied to the discharge points Bd and Cd of the display part, respectively. Reference characters SP, EP, CP and WP identify shift, erase, control and write pulses, respectively.

At first, in the write cycle, the write pulse WP is applied to the write bus WB to generate a discharge spot at the write discharge point W and the firing voltage of the discharge point A adjoining the write discharge point W is lowered by the fire priming effect. Next, a pulse voltage Vsc is applied to the bus X1, with the bus Y1 grounded and the bus Y2 floated off the ground, by which the discharge spot is shifted to the discharge point A. Since the dielectric layer of the shift layer is thin, the discharge is sustained for the period of the pulse width of the pulse voltage and the discharge current is suppressed by the resistor R1l. Then, the bus X1 is grounded and the pulse voltage Vsc is applied to the bus Y1, thereby to generate a discharge spot at the discharge point A. In this manner, the pulse voltage Vsc is applied to the buses X1 and Y1 alternately with each other.

Next, the bus Y1 is put in its floating state and the pulse voltage Vsc is applied to the buses X1 and X2 alternately with each other. In this case, since the firing voltage of the discharge point B is decreased by the discharge spot produced at the discharge point A, a discharge spot is generated at the discharge point B. Thereafter, the discharge spot is sequentially shifted to the discharge points A to D in the same manner as described above. Because of the resistors R1l and R2l, only one discharge spot is produced on one line and is shifted along the line.

When the discharge spot is shifted to the discharge point B, the firing voltages of the discharge points A and C and the discharge point Bd of the display part adjoining the discharge point B are lowered, so that the application of the write pulse WP to the selected terminal Zl produces a discharge spot at the discharge point Bd. Since the discharge point Bd and the adjoining one Cd each have a thick dielectric layer, when a discharge has once been generated therein, a wall voltage is produced, enabling the written content to be stored and displayed at the same time. Further, the discharge spot is displayed to reciprocate between the discharge points Bd and Cd in response to the shift operation of the discharge spot in the shift part.

Even if the write pulse WP for writing information in another discharge point Bd is applied, after the one discharge point Bd of the display part is once discharged, this pulse does not exert any adverse effect on this one discharge point Bd because the write previously applied pulse has the same polarity as the pulse voltage. Since only firing voltages of the discharge points Bd adjoining the discharge spot of the shift part drop, no write takes place.

Thus, information is written by applying the write pulse WP when the position of the discharge spot being shifted and the write position coincide with each other and the written information is stored and displayed by the generation of the wall voltage, so that the discharge spot of the shift part need not be repetitively shifted.

A partial rewrite of the written content can be effected by re-writing a new content after erasing the entire picture or one line, but since a partial erase is possible, the partial rewrite of the written content can be achieved by re-writing required information at the partially erased position. Such a partial erase can be realized with the drive waveform shown in the erase cycle in FIG. 22. That is, when wall charges are present at the discharge point Cd, information is written in the adjoining discharge point Bd in synchronism with the shifting of the discharge spot in the shift part, by which the wall charges at the discharge point Cd can be neutralized and erased. By the adoption of such a waveform which achieves a self erase at the fall of the write pulse WP in the written discharge point Bd, information can be erased at any desired position.

In FIG. 22, the reason for which the voltages applied to the buses X1, X2, Y1 and Y2 bear resemblance to the drive waveform of the AC discharge type, is that the electrodes xd1li and xd2li of the display part are connected to the buses X1 and X2 and are driven as the AC discharge type electrodes. Although the shift part operates as the DC discharge type, the abovesaid voltages take the pulse voltage waveforms. However, the erase pulse EP need not be applied to the buses Y1 and Y2. The buses Y1 and Y2 have the three controlled states of grounding, floating and voltage Vsc application.

Further, in the case of a partial erase, a discharge spot is shifted to the discharge point of the shift part adjoining the discharge point of the display part to be erased and the discharge spot is generated continuously for several to some dozen cycles, by which the erase occurs as a result of the space charges produced by the discharge neutralizing the wall charges at the discharge point of the display part.

As described above, in the present embodiments, the shift and display parts are disposed adjacent to each other, the electrodes of either or both of them forming discharge points are respectively covered with thin dielectric layers and voltages are applied to the discharge points through resistors, respectively, to drive the panel as the DC discharge type. A drive circuit for the DC discharge type panel is simple in structure and inexpensive. Further, since the electrodes are covered with the dielectric layers, the discharge panel can be driven at a relatively low voltage and is long-lived. In conventional DC discharge type panels, electrodes are exposed directly in the discharge gas space and a mercury vapor is also contained in the discharge gas space, so that the temperature dependence of the discharge is large and the lifetime of the panels is relatively short. In the present embodiments, however, the temperature dependence is eliminated by the provision of the thin dielectric layers. In the case of driving the panel of the present embodiments as a DC discharge type panel, since discharge is maintained for the period of voltage application, brightness of the discharge can be controlled by adjusting the voltage application period. This enables a graded display.

Moreover, information is written in the display part utilizing the fire priming effect when the position of the discharge spot being shifted in the shift part and the write position coincide with each other, so that the display content does not shift and the written information can be immediately displayed.

Figure 23:
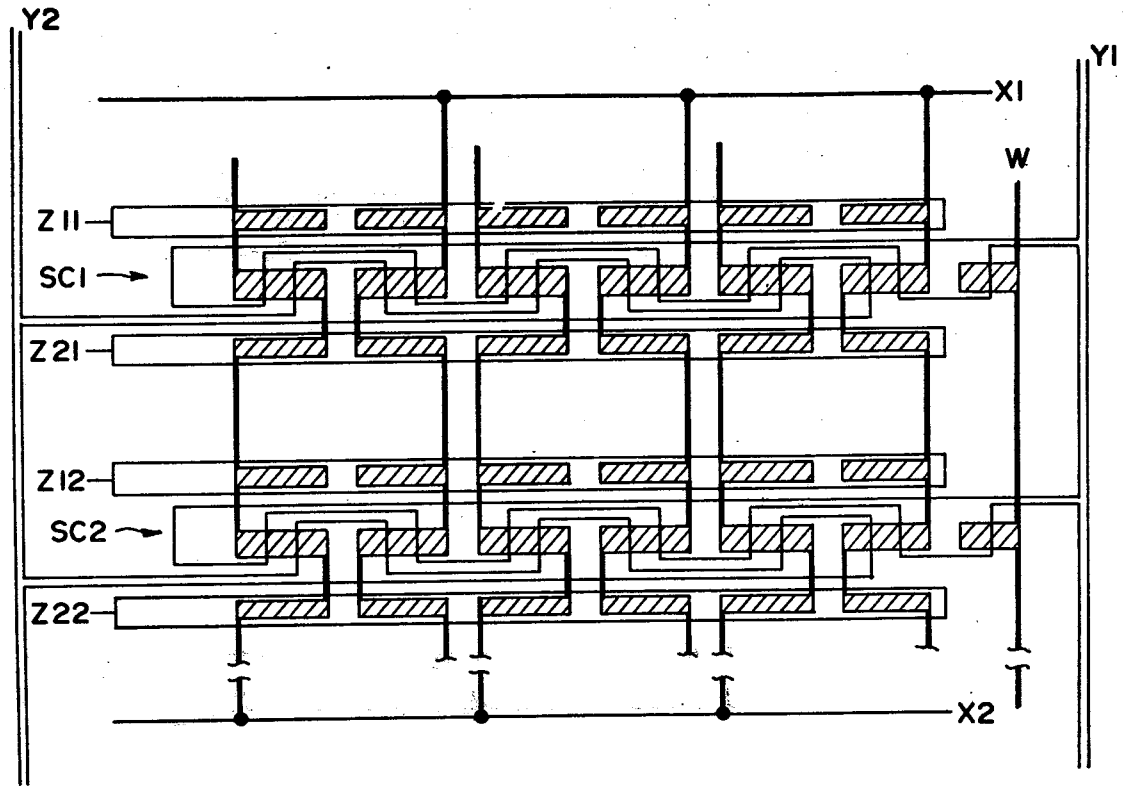
FIG. 23 is a schematic diagram showing an electrode arrangement according to still another embodiment of this invention.

This invention is not limited specifically to the foregoing embodiments but many modifications and variations may be effected. For instance, the write electrode for starting the discharge spot to be scanned or shifted is described to be located at the right-hand side of the discharge panel, but may also be provided on the left-hand side of the panel or on both sides, as mentioned previously. Especially in the case of employing the discharge panel for a monitor display of a keyboard input, it is preferred to adopt such a structure that a discharge spot serving as a priming fire is shifted or scanned from left to right to permit keyed-in information to be successively written from the left-hand side of the panel. Further, in the foregoing embodiments, a display cell array of one line is provided on one side of each discharge spot shift or scan channel, but such a display cell array may also be provided on either side of each shift channel. FIG. 23 shows an electrode arrangement used in such a case. In FIG. 23, independent display electrodes Z11, Z21 and Z12, Z22 are disposed on both sides of two shift channels SC1 and SC2, respectively, and the shift channels are each used in common to two display cell lines. Such a structure improves the efficiency of utilization of the display panel and provides for enhanced resolution.

Many other, modifications and variations of the invention will be obvious in view of the above embodiments of the present invention, such as combinations of the foregoing embodiments or the addition of conventional structures may be effected and the scope of this invention should be construed by the appended claims.

What is claimed is:

1. A plasma display panel comprising:

a plurality of parallel shift channels, each said shift channel comprising a series of shift discharge cells, each said shift cell being defined between opposing portions of a pair of electrodes respectively disposed on a pair of substrates and separated by a gas discharge space, a plurality of display discharge cells located in close association with respective ones of said shift cells, said close association allowing for the fire priming effect of said display cells from discharging ones of said respective shift cells to decrease the firing voltage in said associated display cells, said display cells being similarly defined between opposing portions of display electrodes on said substrates, means for electrically connecting said electrodes of said shift and display cells to respective buses without cross-over for supplying panel operating voltage pulses to shift information in the form of discharge spots selectively along said shift channels and to selectively discharge said display cells by means of said fire priming effect to display said information being shifted.

2. The panel of claim 1, each of said shift channels comprising a meander shift channel having a corresponding periodic and rectangular patterns as a result of the configuration of said shift electrodes and said means for electrically connecting said shift electrodes to said buses.

3. The panel of claim 2 comprising barrier means for preventing any of said cells in a discharge state from interferring with the dsicharge state of each other except as between consecutive shift cells in each said shift channel, and except as intended by each of said display cells having a reduced firing voltage as a result of said close association with said respective shift cells.

4. The panel of claim 3 comprising 2 by 2 phases of operating voltages for said shift channels, said shift electrodes of each said shift channel on a first one of said substrates having a periodic and alternating distribution along a respective two first parallel lines, and said shift electrodes on the second said substrate being arranged in periodic and alternating dsitrubution along a plurality of second parallel lines oriented transversely to said first parallel lines, said alternating distrubutions providing said opposing portions of said shift electrodes to define said meander shift channels along the direction of said first parallel lines, said means for electrically connecting said shift electrodes comprising shift electrode connectors connecting together all said shift electrodes of each line of said parallel lines on each substrate, said shift electrode connectors along each said parallel line on each said substrate being extended at alternating ends of said lines to commonly connect alternate respective ones of said parallel lines of electrodes to two respective ones of said buses on the same said substrate, each of said buses lying along said extended ends of, and oriented transversely to, said parallel lines to which each said bus is commonly connected, said 2 by 2 operating voltage phases being applied to said shift cells by said four buses, said display electrodes of said display cells comprising a display long linear electrode corresponding to each said shift channel and located on said first substrate parallel to said shift channels, each of said long display linear electrodes being sufficiently close to said shift cells corresponding to the closest one of said first parallel lines of shift electrodes of the respective shift channel to allow said fire priming effect from respective ones of said shift cells to said associated display cells, the other electrodes of said display cells comprising said shift electrode connectors on said second substrate extending across each said display long linear electrode, said barrier means comprising means for preventing said fire priming effect between said shift cells lying along each of said parallel lines and not having one of said shift electrodes in common, and for preventing said fire priming effect between a shift cell of one shift channel and an adjacent display cell associated with a shift cell of an adjacent shift channel.

5. The panel of claim 1 each of said shift channels comprising a colinear series of said shfit cells, said shift electrodes of said shift cells of each said shift channel, and said means for electrically connecting said shift electrodes, on a first one of said substrates comprising a pair of shift long linear connectors aligned in the direction of said shift channels, each said shift long linear connector having shift electrode projections extending periodically therefrom toward the other one of said pair of shift long linear connectors, said shift electrode projections of one of said shift long linear connectors intermeshing without overlap with those of the other to provide said portions of said shift electrodes of said colinear shift cells on said first substrate, and said shift electrodes, and said means for electrically connecting said shift electrodes, on second of said substrates comprising a plurality of meander electrodes having a periodic rectangular wave configuration oriented transversely to said shift channels, said shift electrodes on said second substrate having portions opposing respective portions of two adjacent ones of said colinear shift electrodes on said first substrate, and each of said meander electrodes connecting in common respective shift electrodes on said second substrate of each of said shift channels.

6. The panel of claim 5, said display electrodes, and said means for electrically connecting said display electrodes, on said second substrate comprising said meander electrodes and periodic meander display electrode projections from each of said meander electrodes; and said display electrodes, and said means for electrical connection of said display electrodes, on said first substrate comprising a plurality of display long linear electrodes, each one of said display long linear electrodes being oriented parallel and sufficiently close to one of said shift channels to effect said fire priming effect between said respectively associated shift and display cells, said opposing portions of said display cells comprising portions of said display electrode projections and said display long linear electrodes.

7. The panel of claim 6 comprising said fire priming effect between each of said display cells and a respective adjacent two of said shift cells.

8. The panel of claim 7, every consecutive two of said shift cells in each said shift channel having one of said respectively associated display cells.

9. The panel of claim 7 having 2 by 2 shift voltage phases, said means of electrically connecting said shift and dispaly cells comprising on said second substrate extensions of said meander electrodes on said second substrate from alternating ends thereof to electrically connect to a respective two of said buses on said second substrate, each of said buses on said second substrate being located on a respective side of said shift channels, said two buses being oriented transversely to said meander electrodes.

10. The panel of claim 9 comprising a pair of buses on said first substrate for connecting in common respective alternating ones of said shift long linear connectors, said buses being separated by said shift channels, by alternately extending said respective shift long linear connectors to contact said respective buses, whereby said 2 by 2 shift voltage phases may be applied to said shift cells along said 4 buses.

11. The panel of claim 6, comprising a resistor located in series with each of said display long linear electrodes and each of said shift long linear connectors on said first substrate, said resistors having the purpose of allowing only one of said shift and display cells corresponding to each of said shift long linear connectors and said display long linear electrodes, to be in the discharge state at one time.

12. The panel of claim 5 comprising 2 by 3 shift voltage phases for shifting discharge spots in each of said shift channels, said 2 phases corresponding to respective ones of said pair of shift long linear connectors of each said shift channel on said first substrate, and two of said 3 phases corresponding to two groups of said meander electrodes alternately connected to and extending across said shift channels from 2 respective buses on said second substrate to intermesh without overlap with each other, and the third phase corresponding to a meander electrode of a different configuration than said two groups of meander electrodes, said different configuration comprising a second periodic rectangular pattern meandering between said alternately extending meander electrodes of said two groups, each half period of said second periodic pattern comprising crossing transversely all of said shift channels.

13. The panel of claim 12, a respective one of said shift long linear connectors of each said shift channel comprising additional periodic display electrode projections located respectively between adjacent pairs of said shift electrode projections of the same shift long linear connector and extending in the direction away from the other one of the respective said pair of shift long linear connectors to comprise a respective display electrode of each of said display cells, said third meander electrode comprising first periodic third meander electrode projections located across said gas discharge space from respective ones of said display electrode projections extending from said shift long linear connectors, and second periodic third meander electrode projections opposing across said gas discharge space a respective one of said additional periodic display electrode projections to comprise a respective one of said display cells, said close association for said primary firing effect comprising a proximity between each said shift cell and each said display cell respectively corresponding to respective ones of said first and second periodic third meander electrode projections.

14. The panel of claim 6 having 2 by 2 phases of voltage pulses for operating said shift channels and 2 by 2 of said phases for operating said display cells, said panel comprising two of said display long linear electrodes located adjacent to each other and adjacent to each of said shift channels on said first substrate, each of said two display long linear electrodes having periodic display electrode projections alternately projecting without overlap therebetween towards the other one of said two display long linear electrodes, to comprise a colinear series of display electrodes on said first substrate, each said periodic meander electrode projection from said meander electrodes opposing respective portions of an adjacent pair of said periodic display electrode projections, each said shift cell has a unique display cell in said close association for said fire priming effect, and each said closely associated shift and display cell has the same meander electrode in common.

15. The panel of claim 6, said display cells being formed on both sides of each said shift channel, said panel comprising one of said display long linear electrodes on each side of each said shift channel, said meander electrodes having said periodic meander display electrode projections forming said display cells with both said display long linear electrodes.

16. The panel of claim 15, comprising said fire priming effect between each of said display cells, of said display long linear electrodes having the same respective meander electrode in common, and a respective adjacent two of said shift cells.

17. The panel of claim 6, each of said shift and display cells having an insulating layer for AC operation with memory in the form of stored charges between consecutive discharges.

18. The panel of claim 6 comprising said priming fire effect between each of said display cells and a respective one of said shift cells.

19. The panel of claim 18, comprising said priming fire effect between each one of said shift and display cells in each said shift channel having in common one of said meander electrodes.

20. A plasma display panel for shifting information in the form of discharge spots along a plurality of shift channels and for selectively displaying said shifting information in the form of discharge spots in display cells, said panel comprising respective X and Y substrates separated by a gas discharge space, a pair of X buses and a pair of Y buses respectively on said X and Y substrates, Y shift electrodes and Y shift electrode connectors located on said Y substrate, each said shift channel comprising a colinear arrangement of said Y shift electrodes, said Y shift electrodes of each said shift channels being alternately connected by said Y shift electrode connectors to respective ones of said pair of Y buses, said pair of Y buses being separated by said Y shift electrodes, Y linear display electrodes located on said Y substrate, each said Y linear display electrode oriented parallel to and in close proximity to one of said colinear arrangements of said Y shift electrodes, a plurality of X meander electrodes located on said X substrate, each said X meander electrodes having a periodic rectangular configuration oriented transversely to said colinear arrangements of said Y shift electrodes, each said X meander electrodes crossing over all of said transverse colinear arrangements of said Y shift electrodes, alternative ones of said X meander electrodes being connected in common to a respective one of said X buses, said pair of X buses being separated by said meander electrodes, X shift electrodes periodically projecting from said X meander electrodes, each said X shift electrode having respective portions opposing respective portions of two adjacent ones of said Y shift electrodes across said discharge space, to define a shift cell between said opposing portions, the plurality of said shift cells corresponding to each said colinear arrangement of said shift cells comprising one of said shift channels, X display electrodes periodically projecting from said X meander electrodes at locations of said X meander electrodes opposite to a respective portion of said Y linear display electrodes to define display cells between said respective opposing portions of said display electrodes, said alternate connection of said Y shift electrodes connectors and said X meander electrodes to said respective X and Y buses comprising connections without cross over of said Y shift electrodes and said X meander electrodes, said close proximity of said Y linear display electrodes to respective ones of said colinear arrangements allowing for the priming fire effect between each said shift cell and the respective one of said display cells having the same X meander electrode in common.

21. The panel of claim 20, at least said opposing portions of said shift and display cells having an insulating layer for AC operation of said panel with memory function.

22. The panel of claim 20, comprising an insulating layer on selected ones of said electrodes on at least one of said substrates.

23. The panel of claim 22, said insulating layer comprising a thin layer with thickness of the order of several tens of microns.

24. The panel of cliam 22, said insulating layer comprising a thin layer with thickness of the order of several microns.

25. A method for transferring information in the form of a discharge spot in a shift cell of a gas discharge panel into an adjacent display cell with the aid of the fire priming effect, said method comprising:

applying a display sustain pulse across said display cell a sustain said display cell in whatever initial state of discharge prevails in said display cell, said display sustain pulse comprising a sharply rising leading edge and a peak portion followed by a falling edge;

applying a shift cell pulse across siad shift cell to cause said shift cell to discharge within a discharge delay time after the application of said shift cell pulse, said shift cell pulse having a leading edge during said peak portion of said display sustain voltage; and applying a display write pulse across said display cell during said peak portion of said display sustain pulse to cause a discharge in said display cell as a result of said fire priming effect from said discharge in said adjacent shift cell resulting from said shift cell pulse, said display write pulse causing said discharge in said display cell only when said initial discharge state of said display cell is not in the discharge condition, said display write pulse having a relatively narror width compared to said display sustain pulse, whereby said information in the form of said discharge spot in said shift cell is reflected in the final discharge state of said display cell.

26. The method of claim 25, wherein said display sustain pulse, said shift cell pulse and said display write pulse comprise rectangular pulses.

27. The method of claim 25, wherein the leading edge of said display write pulse follows said leading edge of said sustain pulse by sufficient time so that any said discharge in said display cell caused by leading edge of said sustain pulse will not be effected by said display write pulse.

28. The method of claim 25, the leading edge of said display write pulse following the leading edge of said shift cell pulse by a time that is greater than said discharge delay time.

29. The method of claim 26, the falling edge of said display write pulse proceding said falling edge of said display sustain pulse by a time that is sufficiently large to allow the establishment of wall charges whenever said display write pulse causes a discharge in said display cell.

30. The method of claim 26, said display write pulse having a width of 0.2 to 5 microsec, the rising edge of said display write pulse following said rising edge of said write sustain pulse by a time from 1 to 20 microsec, and the leading edge of said display write pulse following the leading edge of said shift cell pulse by a time of up to 3 microsec.

31. The method of claim 26, said ranges having the preferred respective values of 0.3 to 3, 3 to 10, and up to 1 microsec, and the falling edge of said display write pulse preceding said falling edge of said display system pulse by a time in the preferred range from 2 to 10 microsec.

* * * * *

UNITED STATES PATENT AND TRADEMARK OFFICE

CERTIFICATE OF CORRECTION

PATENT NO. : 4,147,960

DATED : April 3, 1979

INVENTOR(S) : Shizuo Andoh et al

It is certified that error appears in the above-identified patent and that said Letters Patent are hereby corrected as shown below:

Column 1, line 22, delete "the".
Column 2, line 1, after "portions" insert --opposite--.
Column 2, line 2, delete "opposite".
Column 3, line 14, "anion-" should be --an ion- --.
Column 4, line 15, "preciding" should be --preceding--.
Column 6, line 25, delete "the" (first occurrence).
Column 9, line 6, delete "a"; after "at" insert --the--.
Column 9, line 8, after "relationship" insert --of--.
Column 9, line 48, "refered" should be --referred--.
Column 18, line 45, "interferring" should be --interfering--.
Column 18, line 45, "dsicharge" should be --discharge--.
Column 20, line 14, "dispaly" should be --display--.
Column 22, line 58, "cliam" should be --claim--.
Column 22, line 66, "a" should be --to--.
Column 23, line 3, "siad" should be --said--.
Column 23, line 18, "narror" should be --narrow--.
Column 24, line 10, "proceding" should be --proceeding--.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*